US010697623B2

(12) United States Patent
Worman et al.

(10) Patent No.: US 10,697,623 B2
(45) Date of Patent: Jun. 30, 2020

(54) PORTABLE AND/OR MOUNTABLE LIGHT HAVING AN ADJUSTABLE LASER AIMING LIGHT

(71) Applicant: Streamlight, Inc., Eagleville, PA (US)

(72) Inventors: William D. Worman, Phoenixville, PA (US); Jon C. Zeisler, Audubon, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 16/413,124

(22) Filed: May 15, 2019

(65) Prior Publication Data

US 2020/0173640 A1 Jun. 4, 2020

Related U.S. Application Data

(62) Division of application No. 15/817,986, filed on Nov. 20, 2017.

(51) Int. Cl.

| | |
|---|---|
| ***F21V 23/04*** | (2006.01) |
| ***F21V 15/01*** | (2006.01) |
| ***F21V 19/00*** | (2006.01) |
| ***F21L 4/00*** | (2006.01) |
| ***F41G 1/35*** | (2006.01) |

(52) U.S. Cl.

CPC ..... *F21V 23/0421* (2013.01); *F21V 15/01* (2013.01); *F21V 19/004* (2013.01); *F21L 4/00* (2013.01); *F41G 1/35* (2013.01)

(58) Field of Classification Search

None

See application file for complete search history.

(56) References Cited

U.S. PATENT DOCUMENTS

| | | | |
|---|---|---|---|
| 2,546,242 | A | 3/1951 | Stinson |
| 2,597,565 | A | 5/1952 | Chandler et al. |
| 2,601,613 | A | 6/1952 | Jahncke |

(Continued)

FOREIGN PATENT DOCUMENTS

| | | |
|---|---|---|
| DE | 202004003173 | 9/2004 |
| EP | 1817521 | 9/2013 |

(Continued)

OTHER PUBLICATIONS

Streamlight, Inc., "Product Catalog," Jun. 2001, Front Cover, pp. 1, 8-11, 28-29, 32-33, Rear Cover.

(Continued)

*Primary Examiner* — Kristy A Haupt

(74) *Attorney, Agent, or Firm* — Clement A. Berard, Esq.; Dann, Dordman, Herrell & Skillman, PC

(57) ABSTRACT

A light comprises: a light body and a laser light source supported by the light body; and a laser light source adjustment arrangement having two adjusting screws at an acute angle to each other. The two adjusting screws bear against the laser light source for adjusting, e.g., the azimuth and elevation of the laser light produced thereby. Alternatively and/or additionally, a tail cap assembly may include a housing shell defining one or more cantilevered supports and a resilient material sealing the housing shell while leaving the actuators flexibly cantilevered. Alternatively and/or additionally, the light may include a mode selecting face cap that is rotatable on the light body for selecting operating modes, including OFF.

30 Claims, 14 Drawing Sheets

(56) References Cited

U.S. PATENT DOCUMENTS

| | | | |
|---|---|---|---|
| 2,743,526 | A | 5/1956 | Ivy |
| 3,153,856 | A | 10/1964 | Felix |
| 3,488,488 | A | 1/1970 | Crouch |
| 3,512,290 | A | 5/1970 | La Violette, Jr. |
| 3,513,581 | A | 5/1970 | Slater |
| 3,877,166 | A | 4/1975 | Ward |
| 3,986,285 | A | 10/1976 | Krisay |
| 4,177,754 | A | 12/1979 | James et al. |
| 4,359,277 | A | 11/1982 | Shimizu et al. |
| 4,489,366 | A | 12/1984 | Rozniecki |
| 4,580,362 | A | 4/1986 | Stevens |
| 4,697,226 | A | 9/1987 | Verdin |
| 4,703,576 | A | 11/1987 | Burris |
| 4,707,772 | A | 11/1987 | Jimenez et al. |
| 4,856,218 | A | 8/1989 | Reynolds, Jr. |
| 4,939,863 | A | 7/1990 | Alexander et al. |
| 5,042,186 | A | 8/1991 | Bechtel |
| 5,180,220 | A | 1/1993 | Van Kalsbeek |
| 5,285,038 | A | 2/1994 | Asher et al. |
| 5,400,540 | A | 3/1995 | Solsinsky et al. |
| 5,422,798 | A | 6/1995 | Osiecki et al. |
| 5,430,967 | A | 7/1995 | Woodman, III et al. |
| 5,522,167 | A | 6/1996 | Teetzel |
| 5,581,898 | A | 12/1996 | Thummel |
| 5,584,137 | A | 12/1996 | Teetzel |
| 5,628,555 | A | 5/1997 | Sharrah et al. |
| 5,669,173 | A | 9/1997 | Rodney, Jr. |
| 5,685,105 | A | 11/1997 | Teetzel |
| 5,758,448 | A | 6/1998 | Thummel |
| 5,816,683 | A | 10/1998 | Christiansen |
| 5,878,628 | A | 3/1999 | Ongaro et al. |
| 5,913,669 | A | 6/1999 | Hansen et al. |
| 6,073,901 | A | 6/2000 | Richter |
| 6,099,147 | A | 8/2000 | Ziegenfuss |
| 6,115,952 | A | 9/2000 | Rigler |
| 6,154,995 | A | 12/2000 | Lenoir |
| 6,185,854 | B1 | 2/2001 | Solinsky et al. |
| 6,230,431 | B1 | 5/2001 | Bear |
| 6,276,088 | B1 | 8/2001 | Matthews |
| 6,283,609 | B1 | 9/2001 | Parsons et al. |
| 6,283,611 | B1 | 9/2001 | Sharrah |
| 6,296,367 | B1 | 10/2001 | Parsons et al. |
| 6,378,237 | B1 | 4/2002 | Matthews |
| 6,425,561 | B2 | 7/2002 | Wooten et al. |
| 6,574,901 | B1 | 6/2003 | Solinsky et al. |
| 6,609,810 | B2 | 8/2003 | Kim |
| 6,612,714 | B1 | 9/2003 | Morre et al. |
| 6,733,153 | B1 | 5/2004 | Lee |
| 6,764,194 | B1 | 7/2004 | Cooper |
| 6,874,269 | B2 | 4/2005 | Chen et al. |
| 7,117,624 | B2 | 10/2006 | Kim |
| 7,188,978 | B2 | 3/2007 | Sharrah et al. |
| D543,446 | S | 5/2007 | DiNenna |
| D548,385 | S | 8/2007 | Sharrah et al. |
| 7,325,352 | B2 | 2/2008 | Matthews et al. |
| D567,894 | S | 4/2008 | Sterling |
| 7,357,534 | B2 | 4/2008 | Snyder |
| D568,508 | S | 5/2008 | Howe et al. |
| D578,599 | S | 10/2008 | Cheng |
| 7,614,760 | B2 | 11/2009 | Sharrah et al. |
| D612,970 | S | 3/2010 | Sharrah et al. |
| 7,726,061 | B1 | 6/2010 | Thummel |
| 7,735,255 | B1 | 6/2010 | Kincaid |
| 7,934,333 | B1 | 5/2011 | Tuz |
| 8,169,165 | B2 | 5/2012 | West |
| 8,226,267 | B2 | 7/2012 | Sharrah et al. |
| 8,256,154 | B2 | 9/2012 | Danielson |
| 8,287,157 | B2 | 10/2012 | Sharrah et al. |
| D673,709 | S | 1/2013 | Sharrah |
| D674,525 | S | 1/2013 | Sharrah et al. |
| D674,858 | S | 1/2013 | Galli |
| 8,371,729 | B2 | 2/2013 | Sharrah et al. |
| 8,510,979 | B1 | 8/2013 | Mortimer |
| 8,683,731 | B2 | 4/2014 | Kowalczyk |
| 8,683,733 | B2 | 4/2014 | Gross |
| 8,713,844 | B2 | 5/2014 | Tuller, Jr. |
| 8,760,085 | B2 | 6/2014 | West |
| D709,981 | S | 7/2014 | Johnston |
| 8,904,698 | B2 | 12/2014 | Riley |
| 8,915,009 | B2 | 12/2014 | Caulk |
| 9,035,576 | B2 | 5/2015 | West |
| D738,455 | S | 9/2015 | Homem de Mello Anderson |
| D738,457 | S | 9/2015 | Johnston |
| 9,182,194 | B2 | 11/2015 | Moore |
| 9,341,440 | B2 | 5/2016 | Moore |
| 9,488,439 | B2 | 11/2016 | Galli |
| 9,658,031 | B1 | 5/2017 | Hedeen |
| D796,622 | S | 9/2017 | Sharrah |
| 9,772,163 | B2 | 9/2017 | Sharrah et al. |
| 2002/0100204 | A1 | 8/2002 | Kim |
| 2002/0148153 | A1 | 10/2002 | Thorpe |
| 2003/0007355 | A1 | 1/2003 | Leen |
| 2003/0179572 | A1 | 9/2003 | Schnell |
| 2004/0068913 | A1 | 4/2004 | Solinsky et al. |
| 2004/0132342 | A1 | 7/2004 | Lien |
| 2004/0169119 | A1 | 9/2004 | Crowell et al. |
| 2005/0068766 | A1 | 3/2005 | Sharrah et al. |
| 2005/0246937 | A1 | 11/2005 | Kim |
| 2005/0270773 | A1 | 12/2005 | Arthur |
| 2006/0083008 | A1 | 4/2006 | Yu |
| 2006/0083009 | A1 | 4/2006 | Hsu |
| 2006/0196099 | A1 | 9/2006 | Matthews et al. |
| 2007/0006512 | A1 | 1/2007 | Williams et al. |
| 2007/0147042 | A1 | 6/2007 | Sharrah et al. |
| 2008/0120891 | A1 | 5/2008 | Wei |
| 2009/0013580 | A1 | 1/2009 | Houde-Walter et al. |
| 2010/0091485 | A1 | 4/2010 | Matthews et al. |
| 2010/0097789 | A1 | 4/2010 | Sharrah |
| 2010/0176741 | A1 | 7/2010 | Sharrah et al. |
| 2011/0058362 | A1* | 3/2011 | Sun ..... F41G 1/35 362/187 |
| 2012/0124885 | A1 | 5/2012 | Caulk |
| 2012/0144718 | A1 | 6/2012 | Danielson |
| 2013/0074351 | A1 | 3/2013 | Kowalczyk |
| 2013/0145672 | A1 | 6/2013 | Tuller |
| 2015/0102743 | A1 | 4/2015 | West |
| 2015/0103517 | A1 | 4/2015 | Maglica |
| 2015/0113851 | A1 | 4/2015 | Bensayan |
| 2015/0159847 | A1 | 6/2015 | Galli |
| 2015/0192391 | A1 | 7/2015 | Moore |
| 2015/0233668 | A1 | 8/2015 | Moore |
| 2015/0276347 | A1 | 10/2015 | Sharrah |
| 2015/0276352 | A1 | 10/2015 | Chang et al. |
| 2016/0021329 | A1 | 1/2016 | Sakiewicz |
| 2016/0169483 | A1 | 6/2016 | Sharrah et al. |
| 2016/0209167 | A1 | 7/2016 | Wells |
| 2016/0209168 | A1 | 7/2016 | Sharrah et al. |
| 2016/0305742 | A1 | 10/2016 | Kowalcazyk |

FOREIGN PATENT DOCUMENTS

| | | |
|---|---|---|
| EP | 3045857 | 7/2016 |
| JP | 1995119715 | 5/1995 |
| JP | 1998069807 | 3/1998 |
| WO | 2000/077470 | 12/2000 |
| WO | 2006/055439 | 5/2006 |
| WO | 2010/083138 | 7/2010 |

OTHER PUBLICATIONS

Streamlight, Inc., "M2 Universal Tactical Light," Product Package, Prior to Oct. 24, 2006, 1 Pg.

Streamlight, Inc., "M2 Universal Tactical Light," Operator's Manual, Oct. 2003, 2 Pages.

Streamlight, Inc., "M-3 LED Tactical Navigation Light," Dated: 2002, Eagleville, PA, 2 Pages.

Streamlight, Inc., "M-6 Tactical Laser Illuminator," Dated 2003, Eagleville, PA, 2 Pages.

Stream Light, Inc., "Introducing the All-New MIL-SPEC X-Series—Trusted Tactical Lights Taken to the X-treme," Dated: Oct. 2003, Eagleville, PA, 2 Pages.

Streamlight, Inc., "L.A.M. Laser Aiming Module," Dated 2000, Eagleville, PA, 2 Pages.

(56) References Cited

OTHER PUBLICATIONS

Stream Light, Inc., "Tactical Series Specifications," http://www.streamlight.com/tactical_specifications.htm, Printed Oct. 28, 2004, 3 Pages.
Stream Light, Inc., "Tactical Series Parts & Accessories," Specifications, http://www.streamlight.com/tactical_accessories.htm, Printed Oct. 28, 2004, 2 Pages.
Streamlight, Inc., Streamlight M-3 LED, Streamlight Products, http://www.streamlight.com/m3led_specs.htm, Printed Oct. 28, 2004, 1 Page.
Streamlight, Inc., Streamlight M-6, M-6 Tactical Laser Illuminator Specifications, http://www.streamlight.com/m6_specifications.htm, Printed Oct. 28, 2004, 1 Page.
Streamlight, Inc., "Streamlight Laser Aiming Module (L.A.M.)," Streamlight Products, http://www.streamlight.com/lam_specs.htm, Printed Oct. 28, 2004, 2 Pages.
Stream Light, Inc., "X-Series Specifications", http://www.streamlight.com/x-series_specs.htm, Printed Oct. 28, 2004, 2 Pages.
Stream Light, Inc., "Tactical Gun Mount Series—TLR-1", http://www.streamlight.com/product/product.aspx?pid=80, Printed Sep. 18, 2006, 1 Page.
Stream Light, Inc., "Tactical Gun Mount Series—TLR-2 With Laser Sight", http://www.streamlight.com/product/product.aspx?pid=81, Printed Sep. 18, 2006, 1 Page.
Stream Light, Inc., "Tactical Gun Mount Series—TLR-1", http://streamlight.com/product/product.aspx?pid=80, Printed Mar. 9, 2009, 2 pages.
First Samco, "Tactical Light Holder," First Samco Tactical Accessories for AR15 & M/16, http://www.firstsamco.com/catalog/productdetail.php?ID=4, Printed Nov. 4, 2004, 1 Page.
First Samco, "Images for Tactical Light Holder," First Samco Tactical Accessories for AR15 & M/16, http://www.firstsamco.com/catalog/moreimages.php?ID=4, Printed Nov. 4, 2004, 1 Pg.
Insight Technology, Inc., M2 UTL Universal Tactical Light (with Photos), © 2004, http://www.insightlights.com/products/showProduct.asp?id=1, Printed Nov. 8, 2005, 4 Pgs.
Insight Technology, Inc., "M3X Tactical Illuminator," © 2004, http://www.insightlights.com/products/showProduct.asp?id=6, Printed Oct. 28, 2004, 2 Pages.
Insight Technology, Inc., "M6 Tactical Illuminator (with Photos)," © 2004, http://www.insightlights.com/products/showProduct.asp?id=9, Printed Oct. 28, 2004, 5 Pages.
Insight Technology, Inc., "M6X Tactical Illuminator (with Photos),"© 2004 http://www.insightlights.com/products/showProduct.asp?id=11, Printed Oct. 28, 2004, 6 Pgs.
Insight Technology, Inc., "XML X-treme Mini Light", © 2004, http://www.insightlights.com/products/showProduct.asp?id=2, Printed Oct. 28, 2004, 1 Page.
Insight Technology, Inc., "Tactical Lights by Insight Technology Inc. (UTL, M3, LAM)—Products by Product Index", © 2001, http://www.insightlights.com/oldsite/prodbyproducts.htm, Printed Sep. 18, 2006, 1 Page.
Insight Technology, Inc., "Tactical Lights by Insight Technology Inc. (UTL, M3, LAM)—The M3 Tactical Light", © 2001, http://www.insightlights.com/oldsite/prod_m3.htm, Printed Sep. 18, 2006, 1 Page.
Insight Technology, Inc., "Tactical Lights by Insight Technology Inc. (UTL, M3, LAM)—M3 Photo Gallery", © 2001, http://www.insightlights.com/oldsite/gallery_m3.htm, Printed Sep. 18, 2006, 1 Page.
Insight Technology, Inc., "Tactical Lights by Insight Technology Inc. (UTL, M3, LAM)—The M3-LED Tactical Illuminator", © 2001, http://www.insightlights.com/oldsite/prod_m3led.htm, Printed Sep. 18, 2006, 2 Pages.
Insight Technology, Inc., "Tactical Lights by Insight Technology Inc. (UTL, M3, LAM)—M3—LED Photo Gallery", © 2001, http://www.insightlights.com/oldsite/gallery_m3led.htm, Printed Sep. 18, 2006, 1 Page.
Insight Technology, Inc., "Tactical Lights by Insight Technology Inc. (UTL, M3, LAM)—The M4 and M4-Pro Tactical Light", © 2001, http://www.insightlights.com/oldsite/prod_m4.htm, Printed Sep. 18, 2006, 1 Page.
Insight Technology, Inc., "Tactical Lights by Insight Technology Inc. (UTL, M3, LAM)—M4 & M4-Pro Photo Gallery", © 2001, http://www.insightlights.com/oldsite/gallery_m4.htm, Printed Sep. 18, 2006, 1 Page.
Insight Technology, Inc., "Tactical Lights by Insight Technology Inc. (UTL, M3, LAM)—The M5 Tactical Light", © 2001, http://www.insightlights.com/oldsite/prod_m5.htm, Printed Sep. 18, 2006, 1 Page.
Insight Technology, Inc., "Tactical Lights by Insight Technology Inc. (UTL, M3, LAM)—M5 Photo Gallery", © 2001, http://www.insightlights.com/oldsite/gallery_m5.htm, Printed Sep. 18, 2006, 1 Page.
Insight Technology, Inc., "Tactical Lights by Insight Technology Inc. (UTL, M3, LAM)—The M6 Tactical Laser Illuminator", © 2001, http://www.insightlights.com/oldsite/prod_m6.htm, Printed Sep. 18, 2006, 2 Pages.
Insight Technology, Inc., "Tactical Lights by Insight Technology Inc. (UTL, M3, LAM)—M6 Photo Gallery", © 2001, http://www.insightlights.com/oldsite/gallery_m6.htm, Printed Sep. 18, 2006, 1 Page.
Insight Technology, Inc., "Tactical Lights by Insight Technology Inc. (UTL, M3, LAM)—Laser Aiming Module (LAM)", © 2001, http://www.insightlights.com/oldsite/prod_lam.htm, Printed Sep. 18, 2006, 2 Pages.
Insight Technology, Inc., "Tactical Lights by Insight Technology Inc. (UTL, M3, LAM) LAM Photo Gallery", © 2001, http://www.insightlights.com/oldsite/gallery_lam.htm, Printed Sep. 18, 2006, 1 Page.
Insight Technology, Inc., "Tactical Lights by Insight Technology Inc. (UTL, M3, LAM)—Parts & Accessories Photo Gallery", © 2001, http://www.insightlights.com/oldsite/gallery_access.htm, Printed Sep. 18, 2006, 2 Pages.
Insight Technology, Inc., "X-treme Functionality . . . XTI Procyon", © 2008, http://www.insightlights.com/products-procyon.htm, Printed Mar. 12, 2009, 1 page.
Insight Technology, Inc., "X-treme Design . . . X2", © 2008, http://www.insightlights.com/products-x2.htm, Printed Mar. 12, 2009, 1 page.
Insight Technology, Inc., "X2 Sub-Compact Operator Manual", Rev. Apr. 2005, 6 pages.
Surefire, "Laser Sights," Weapon mounted laser sights from SureFire, © 2001-2004, http://www.surefire.com/maxexp/main/co_disp/displ/pgrfnbr/364/sesent/00, Printed Oct. 28, 2004, 1 Page.
Surefire, "Weapon Lights," Lights for weapons including handguns, shotguns, and rifles, © 2001-2004, http://www.surefire.com/maxexp/main/co_disp/displ/pgrfnbr/211/sesent/00, Printed Oct. 28, 2004, 1 Page.
Surefire, "Handgun Weapon Lights," Handgun Tactical WeaponLights provided by SureFire, © 2001-2004, http://www.surefire.com/maxexp/main/co_disp/displ/carfnbr/91/sesent/00, Printed Oct. 28, 2004, 2 Pages.
Surefire, "Products," X200 WeaponLight—X200 avalible from SureFire, © 2001-2004, http://www.surefire.com/maxexp/main.pl?pgm-co_disp&func-displ&strfnbr=6&prrfnbr=1110& . . . , Printed Oct. 28, 2004, 2 Pages.
Surefire, "SureFire Integrated Shotgun WeaponLights," Shotgun WeaponLights provided by SureFire, © 2001-2004, http://www.surefire.com/maxexp/main/co_disp/displ/carfnbr/92/sesent/00, Printed Oct. 28, 2004, 1 Page.
Surefire, "Rifle, Carbine & Smg Light Systems," Rifle, Carbine & SMG WeaponLights Systems provided by SureFire, © 2001-2004, http://www.surefire.com/maxexp/main/co_disp/displ/carfnbr/93/sesent/00, Printed Oct. 28, 2004, 1 Page.
Surefire, "Rifle, Carbine & SMG Light Systems," Millennium Forends provided by SureFire, © 2001-2004, http://www.surefire.com/maxexp/main/co_disp/displ/carfnbr/265/sesent/00, Printed Oct. 28, 2004, 1 Page.
Surefire, "Rifle, Carbine & SMG Light Systems," Millennium Universal WeaponLights provided by SureFire, © 2001-2004, http://

(56) References Cited

OTHER PUBLICATIONS www.surefire.com/maxexp/main/co_disp/displ/carfnbr/267/sesent/00, Printed Oct. 28, 2004, 1 Page.
Surefire, "Rifle, Carbine & SMG Light Systems," Millennium Vertical Foregrip System provided by SureFire, © 2001-2004, http://www.surefire.com/maxexp/main/co_disp/displ/carfnbr/266/sesent/00, Printed Oct. 28, 2004, 1 Page.
Surefire, "Rifle, Carbine & SMG Light Systems," Classic Series WeaponLights provided by SureFire, © 2001-2004, http://www.surefire.com/maxexp/main/co_disp/displ/carfnbr/271/sesent/00, Printed Oct. 28, 2004, 1 Page.
Surefire, "Weapon Mounts," SureFire Weapon Mounts, © 2001-2004, http://www.surefire.com/maxexp/main/co_disp/displ/pgrfnbr/378/sesent/00, Printed Oct. 28, 2004, 1 Page.
Surefire, "Products Weapon Mounts,"Picatinny forends provided by SureFire, © 2001-2004, http://www.surefire.com/maxexp/main/co_disp/displ/carfnbr/312/sesent/00, Printed Oct. 28, 2004, 1 Page.
Surefire, "Products Weapon Mounts,"S.I.R. System C (Selective Integrated Rail)—M61 available from SureFire, © 2001-2004, http://www.surefire.com/maxexp/main/co_disp/displ/pranbr/824/sesent/00, Printed Oct. 28, 2004, 1 Page.
Falcon Tactical, "Sig Sauer Stoplite Vertical Grip with Weaponlight", http://www.falcontactical.net/sigsastvegrw.html, © 2006-2009, 2 pages.
Laserlyte, "Sight TGL DB .380/9MM Tan", printed Jan. 13, 2015,4 pages, http://www.laserlyte.com/products/sight-tgl-diamondback-380-9mm-tan.
Laserlyte, "Glock Lasers", printed Jan. 13, 2015, 1 page, http://www.laserlyte.com/collections/glock.
Laserlyte, "Springfield XD/XDM/XDS Lasers", printed Jan. 13, 2015, 1 page, http://www.laserlyte.com/collections/xd-xdm-xds.
Laserlyte, "SCCY Laser Sight", printed Jan. 13, 2015, 1 page, http://www.laserlyte.com/collections/sccy-laser-sight.
Laserlyte, "Hi-Point Laser", printed Jan. 13, 2015, 1 page, http://www.laserlyte.com/collections/hi-point-laser.
Laserlyte, "Closeouts", printed Jan. 13, 2015, 1 page, http://www.laserlyte.com/collections/discontinued-closeouts.
Laserlyte, "UTA-DB Diamondback Laser", Rev 8/13, 2 pages.
Diodes Incorporated, "PAM2804 1A Step Down Constant Current, High Efficiency LED Driver", Jan. 2013, 10 pages.
Microchip Technology, Inc., "PIC12F7525/HV752 Data Sheet, 8-Pin, Flash-Based 8-Bit CMOS Microcontrollers", ©2011, 210 pages.
Crimson Trace Corporation, "Crimson Trace CMR-202 Rail Master", Instruction Handbook, 27-1455 REV001 04/12, 2 pages.
European Patent Office, "European Search Report, EP Application No. 16150798", dated May 19, 2016, 8 pages0.
Streamlight, Inc., "TLR-6 Subcompact Gun-Mounted Tactical Light With Integrated Red Aiming Laser", © 2016, 5 pages, www.streamlight.com.
Crimson Trace Corporation, "LTG-736 Lightguard for Glock Full-Size and Compact", ©2016, 3 pages, http://www.crimsontrace.com/.
Crimson Trace Corporation, "LG-452 Laserguard Green Laser Sight for Glock Full-Size and Compact", © 2016, 7 pages, http://www.crimsontrace.com/.
Crimson Trace Corporation, "DS-121 Defender Series Accuguard Laser Sight for Glock Full-Size and Compact", ©2016, 10 pages, http://www.crimsontrace.com/products/manufacturer/glock/01-5100.
Streamlight, Inc., "Modular Light Mountable on a Handgun", U.S. Appl. No. 15/283,788, filed Oct. 3, 2016, 61 pages.
Streamlight, Inc., "Mountable Light", Design U.S. Appl. No. 29/623,319, filed Oct. 24, 2017, 18 pages.
Streamlight, Inc., "Mountable Light", Design U.S. Appl. No. 29/623,320, filed Oct. 24, 2017, 18 pages.
Streamlight, Inc., "TLR-1 HL Super Bright, 800 Lumen LED Tactical Weapon Light", Product Specifications, 2 pages, date prior to Oct. 24, 2017 filed, www.streamlight.com.
Streamlight, Inc., "TLR-1 HL High Lumen, Rail-Mounted Tactical Light", Data Sheet, 1 page, dated Jan. 2016, www.streamlight.com.
Streamlight, Inc., "TLR-2 HL Super Bright, 800 Lumen LED Tactical Weapon Light with Red Aiming Laser", Product Specifications, 2 pages, date prior to Oct. 24, 2017 filing date, www.streamlight.com.
Streamlight, Inc., "TLR-2 HL/TLR-2 HL G High Lumen, Rail-Mounted Tactical Light with Aiming Laser", Data Sheet, 1 page, dated Jan. 2016, www.streamlight.com.
Stream light, Inc., "TLR-3 Compact Tactical Weapon-Mounted Light", Product Specifica tions, 2 pages, date prior to Oct. 24, 2017 filing date, www.streamlight.com.
Streamlight, Inc., "TLR-4 Compact Tactical Light with Integrated Red Aiming Laser", Product Specifica tions, 2 pages, date prior to Oct. 24, 2017 filing date, www.streamlight.com.
Streamlight, Inc., "TLR-VIR Infrared Tactical Weapons Light", Product Specifications, 2 pages, date prior to Oct. 24, 2017 filed, www.streamlight.com.
Stream light, Inc., "TLR-VIR, Rail-Mounted Tactical Light with Visible White Light and IR Illuminator", Data Sheet, 1 page, dated Jun. 2016, www.streamlight.com.
Stream light, Inc., "TLR-VIR Pistol Infrared Tactical W eapons Light", Product Specifica tions, 2 pages, date prior to Oct. 24, 2017 filing date, www.streamlight.com.
Streamlight, Inc., "TLR-6 Trigger Guard Mounted Weapon Light with Integrated Red Aiming Laser", Product Specifications, 2 pages, date prior to Oct. 24, 2017 filing date, www.streamlight.com.
Streamlight, Inc., "TLR-6 Subcompact Gun-Mounted Tactical Light with Integrated Red Aiming Laser", Data Sheet, 2 pages, dated Mar. 2017, www.streamlight.com.
Stream light, "Stinger, PolyStinger, SuperStinger, StingerXT Operating Instructions", © 1998, 3 pages.
Streamlight, "Stinger LED, Stinger DS LED Operating Instructions", © 2007, 6 pages.
Streamlight, "NightFighter Series, TL-Series Operating Instructions", © 2008, 2 pages.
Streamlight, "Product Fact Sheet—NightFighter/NightFighter LED Lithium Power Tactical Flashlight", Rev. Sep. 15, 2009, 3 pages.
Stream light, "Product Fact Sheet—TL-2/TL-2 LED Lithium Powered Tactical Flashlight", Rev. Sep. 15, 2009, 3 pages.
International Searching Authority, "PCT—International Search Report & Written Opinion", PCT/US2018/060702, dated Mar. 26, 2019, 14 pages.

* cited by examiner

FIG. 8A
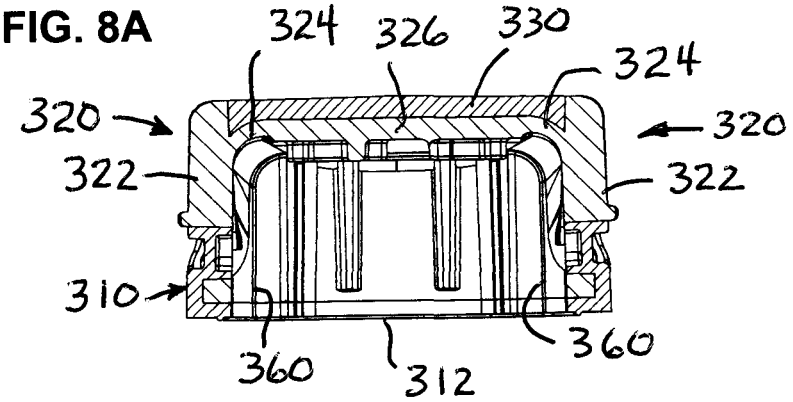
FIG. 8B
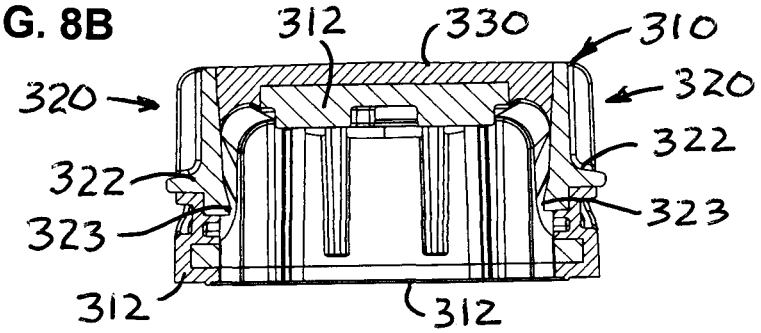
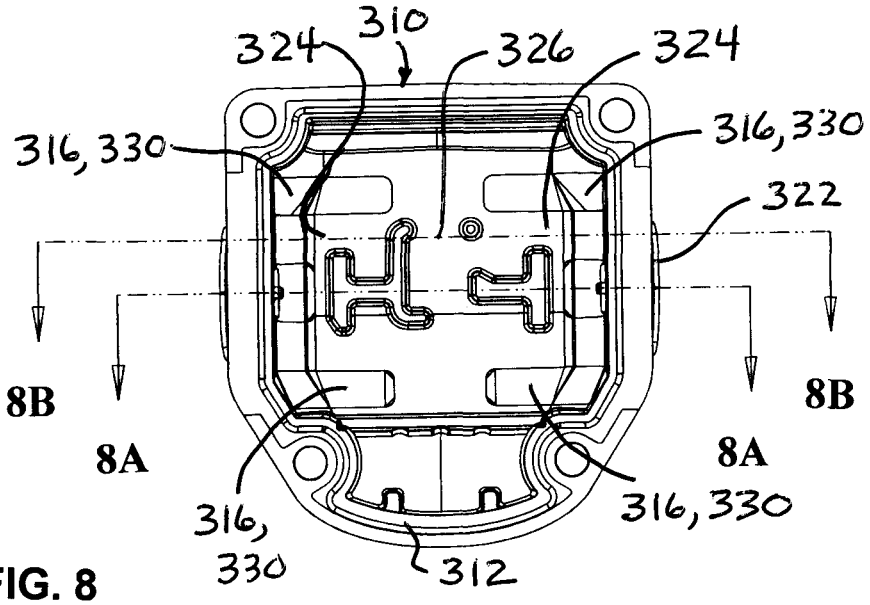
FIG. 8
WITH OVERMOLD

WITHOUT OVERMOLD

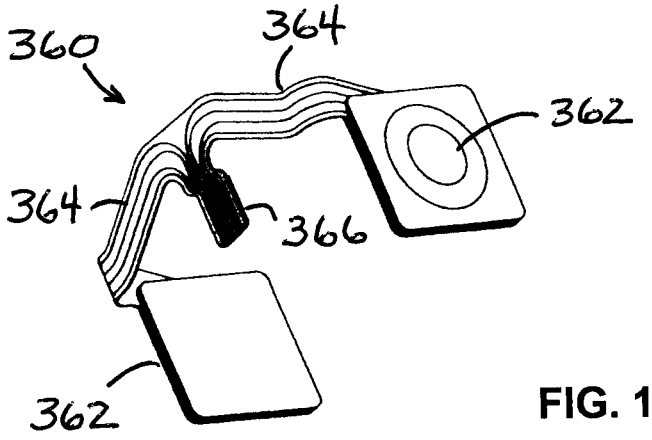
FIG. 10
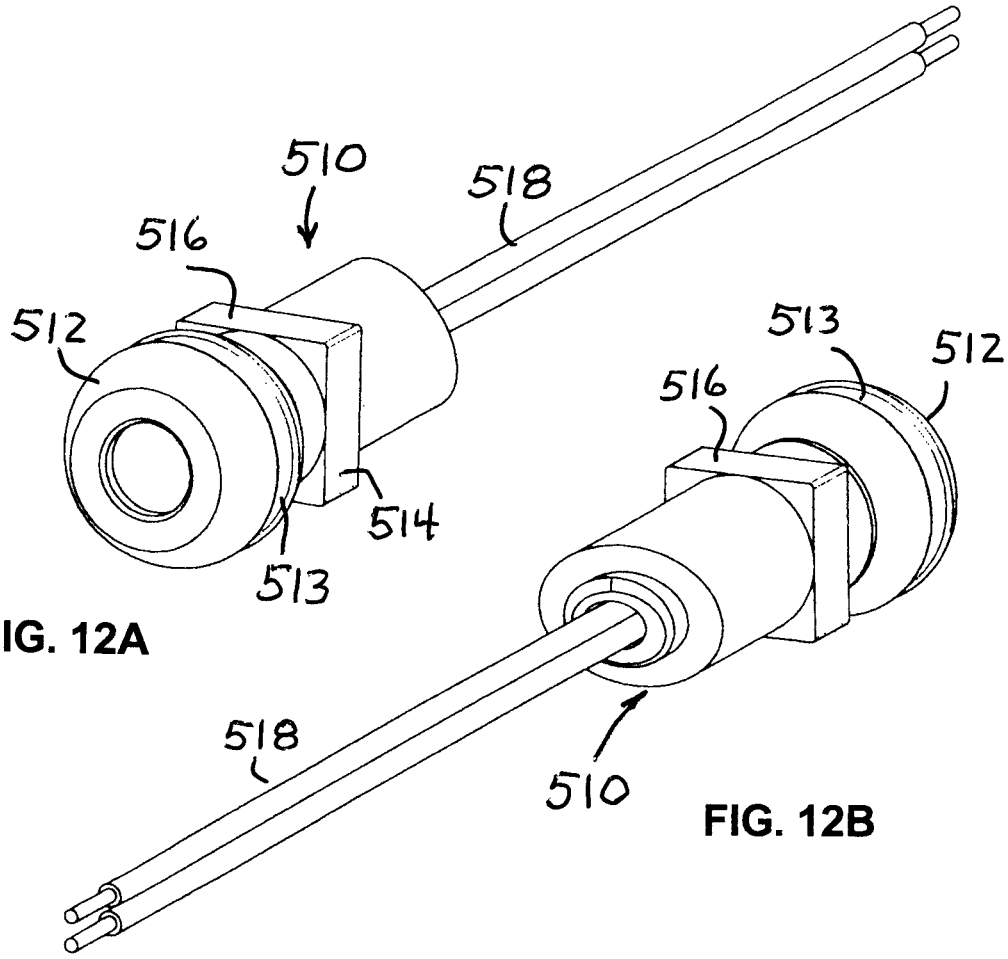
FIG. 12A
FIG. 12B

PORTABLE AND/OR MOUNTABLE LIGHT HAVING AN ADJUSTABLE LASER AIMING LIGHT

This Application is a division of U.S. patent application Ser. No. 15/817,986 filed Nov. 20, 2017, entitled "PORTABLE AND/OR MOUNTABLE LIGHT" which is hereby incorporated herein by reference in its entirety.

The present invention relates to a light and, in particular, to a light having a laser adjustment arrangement, and/or having a versatile switching arrangement, and/or having a mode selecting face cap, or having any combination thereof.

The present light may be portable, e.g., of a size and weight that it can be carried by a person, and/or may be mountable, e.g., mountable on a weapon or other object.

Lights mountable on a weapon, e.g., a long arm or a hand gun, have been available for many years. The TLR-1, TLR-2, TLR-3 and TLR-4 lights available from Streamlight, Inc. of Eagleville, Pa., have provided a new standard of efficiency and quality in this field. While those mountable lights have been and are the "gold-standard" for high quality, rugged gun mountable lights for many years, opportunities for improvement have arisen.

The advent of higher power light emitting diodes and of batteries having higher energy density have helped to make such mountable lights more powerful and versatile, however, the interface with the user of such lights may or may not be convenient and/or easy to use. Often, the configuration of the control switch that turns the light ON, e.g., in a momentary ON or in a continuous ON condition, is such that a particular motion may be required to actuate the switch and/or the actuation motion may differ for right and left handed operation.

Moreover, with the addition of features to some lights, e.g., a laser light source for aiming and/or an operating mode selector, the size of many lights has increased. In the case of gun mounted lights this tends to make them less desirable for use, especially with smaller weapons such as concealable hand guns or guns made for smaller persons, and/or to make it more difficult to configure the light so that it will fit neatly into an available space, e.g., the pocket defined forward of the trigger guard beneath the barrel.

For example, the popular CR-123 lithium battery desirably has a higher energy density than an alkaline battery of like size, however, it is also physically larger than the widely used AA and AAA alkaline batteries and so tends to increase the size of a light that will use a CR-123 cell. While high energy lithium batteries are available in several package sizes, as are batteries of other chemistries, their electrical capacity is directly related to their physical size and so a battery of smaller physical size can store less energy than can a larger battery of the same chemistry, thereby limiting the operating or "run time" of the device it powers. To a flashlight designer, the battery size is fixed by the batteries that are commercially available, and so other solutions are needed to maintain or reduce the physical size of such lights or to limit the increase in size as new and/or additional features are provided.

Further, many modern lights have different operating modes wherein different kinds of light are produced, e.g., white light for illumination, infrared (IR) light for illuminating a target for using night vision equipment, and/or for enabling and disabling a particular light source, e.g., a laser light source. In many lights repeatedly actuating an electrical switch actuator causes the light to sequence through various different modes. In certain operations, e.g., those involving police, security and/or military personnel, it may be desirable to be able to change modes, e.g., to change light sources, without the light turning on, and/or to preclude the light from producing light unless and until it is otherwise turned on.

Applicant believes there may be a need for a light having a versatile switching arrangement that is convenient for a user, and/or that can be configured to operate in the same way whether actuated right-handedly or left handedly.

Applicant also believes that it would be desirable to reduce the size of lights, e.g., lights mountable on a weapon, e.g., particularly those that include a laser or other aiming light that tends to increase the size of a light.

Applicant further believes that there may be need for a convenient control arrangement for positively and simply accessing particular modes of operation of a light, and/or for limiting the operating modes that a light may access in a particular condition. Among these may be a mode to preclude the light from producing light irrespective of an actuation.

Accordingly, a light may comprise: a light body and a light source supported by the light body for selectively producing light; and a tail cap assembly of the light body including one or more actuators configured for actuating one or more electrical switch contacts internal to the light body for energizing the light source to produce light. The tail cap assembly may further include a housing shell defining one or more cantilevered supports extending from the housing shell and the one or more actuators being at respective ends of the one or more cantilevered supports. The tail cap assembly may further include a resilient material for sealing the housing shell while leaving the actuators flexibly cantilevered.

Alternatively and/or additionally, a light may comprise: a light body having a threaded opening and one or more electrical contacts disposed proximate the threaded opening. A light source assembly supported by the light body may include: a light source; an optically reflective element disposed adjacent the light source; a threaded member supporting the light source and optically reflective element has a threaded cylindrical part at an end configured to be threaded into the threaded opening; and the end of the light source assembly has one or more ridges and/or recesses near its periphery for engaging the one or more electrical contacts when the light source assembly is at a first predetermined rotational position relative to the light body, the end of the light source assembly having one or more mode selecting electrical contacts near its periphery for respectively making electrical contact with the one or more electrical contacts of the light body when the light source assembly is at one or more respective different predetermined rotational positions relative to the light body. The one or more mode selecting electrical contacts are coupled to the source of electrical power via the one or more electrical contacts of the light body for energizing the light source.

Alternatively and/or additionally, a light including a laser light source arrangement may comprise: a laser light source configured to emit laser light along a longitudinal axis of the laser housing, the laser housing defining a first side thereof that is substantially parallel to the longitudinal axis and defining a second side thereof that is substantially parallel to the longitudinal axis and substantially perpendicular to the first side thereof, the first and second sides of the laser housing being spaced away from the forward end of the laser light source; a light body having a receptacle for receiving the laser light source; a biasing spring configured to bias the laser light source to move transversely to the longitudinal axis in a direction that is not perpendicular to either the first side or to the second side of the laser housing; a first laser aiming screw in a threaded hole in the light body disposed for bearing against the first side of the laser housing in opposition to the bias of the biasing spring, wherein rotating the first laser aiming screw in a first direction causes the laser housing to move in opposition to the bias of the biasing spring and wherein rotating the first laser aiming screw in an opposite direction causes the laser housing to move under the bias of the biasing spring; a second laser aiming screw in a threaded hole in the light body that is at an acute angle relative to the threaded hole for the first laser aiming screw, the second laser aiming screw being disposed for bearing against the second side of the laser housing in opposition to the bias of the biasing spring, wherein each of the first and second laser aiming screws has a longitudinal axis that is substantially transverse to the longitudinal axis of the laser housing, wherein the longitudinal axis the second laser aiming screw is at the acute angle relative to the longitudinal axis of the first laser aiming screw, wherein rotating the second laser aiming screw in a first direction causes the laser housing to move in opposition to the bias of the biasing spring and wherein rotating the second laser aiming screw in an opposite direction causes the laser housing to move under the bias of the biasing spring. The laser housing may have a forward end substantially defining a portion of a hemisphere about the longitudinal axis, and the receptacle may have a forward end configured for receiving the forward end of the laser housing and an opening therethrough for passing the laser light emitted by the laser source.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include:

FIG. 8 is a view of an internal end of the example embodiment of the tail cap which includes an over-molded material, and FIGS. 8A and 8B are respective cross-sectional views thereof in two different planes;

FIG. 10 is a perspective view of an example embodiment of a circuit structure providing electrical contacts that cooperate with the example tail cap of FIGS. 7A through 9B;

FIGS. 12A and 12B are perspective views of an example laser light source suitable for use with the example arrangement of FIGS. 11 through 11B;

Figure 1A:
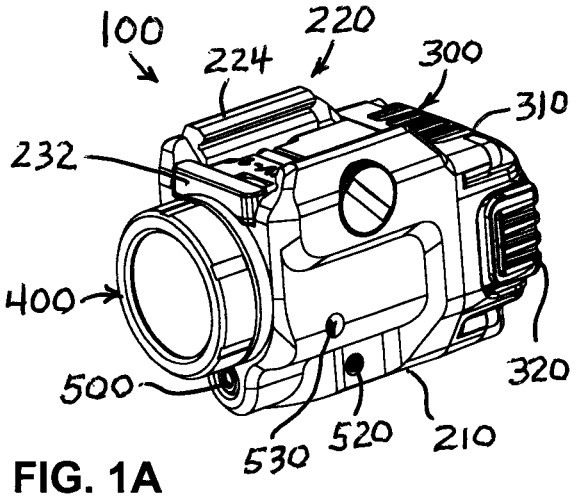
FIGS. 1A through 1F are perspective views of an example embodiment of a light that is mountable on a weapon.
Figure 1B:
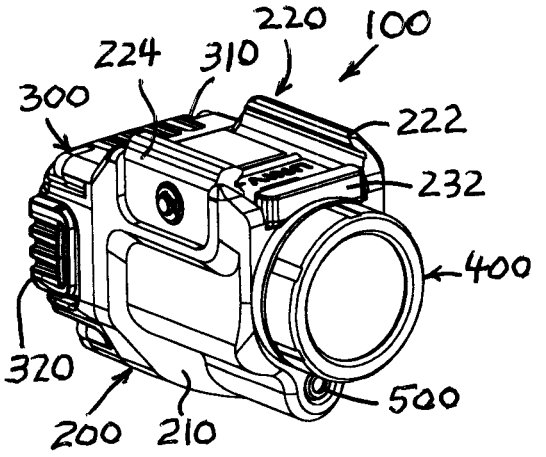
Figure 1C:
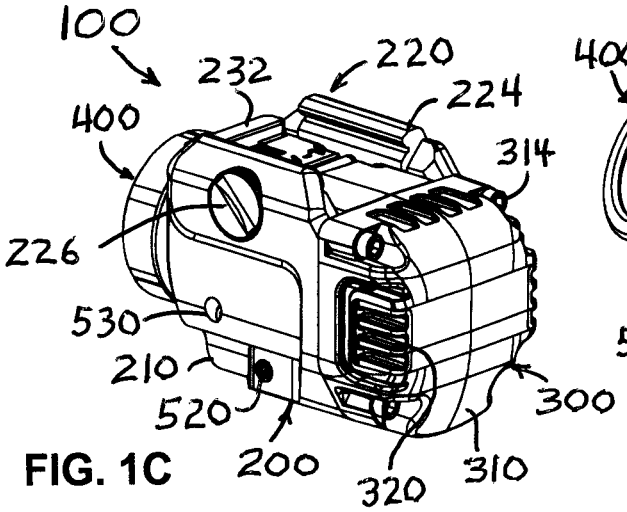
Figure 1D:
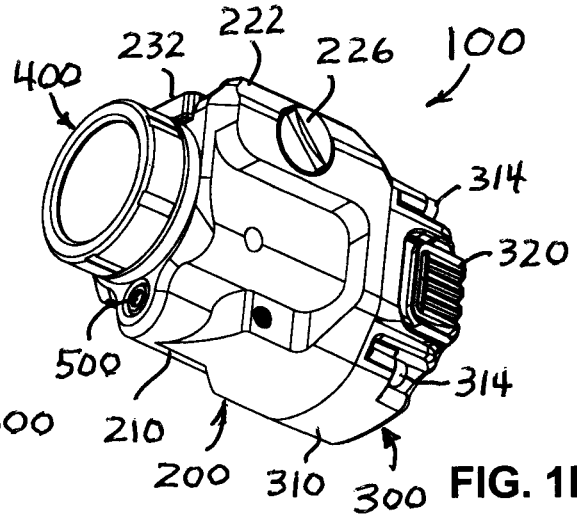
Figure 1E:
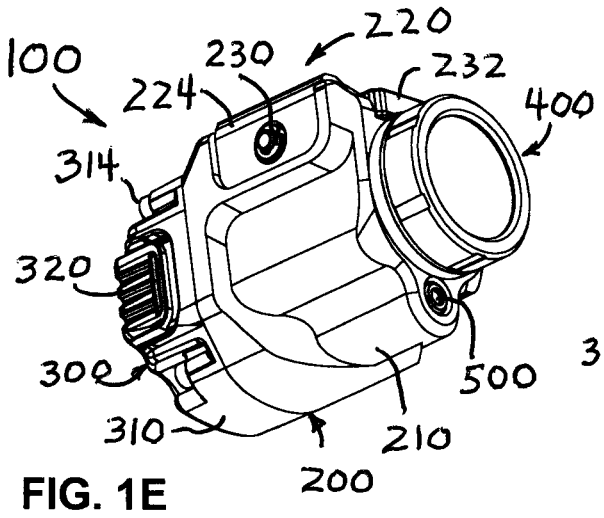
Figure 1F:
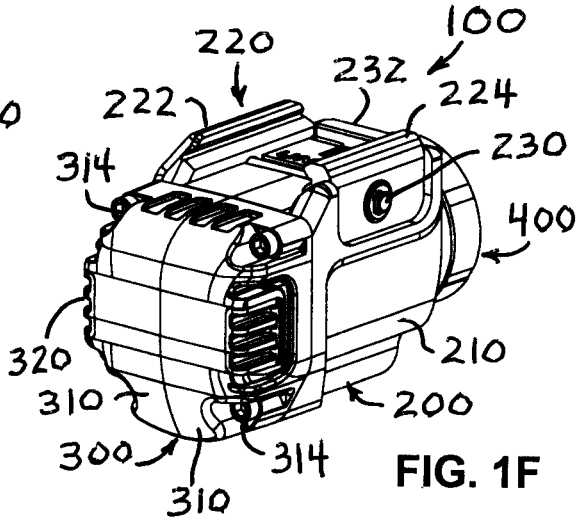
Figure 2A:
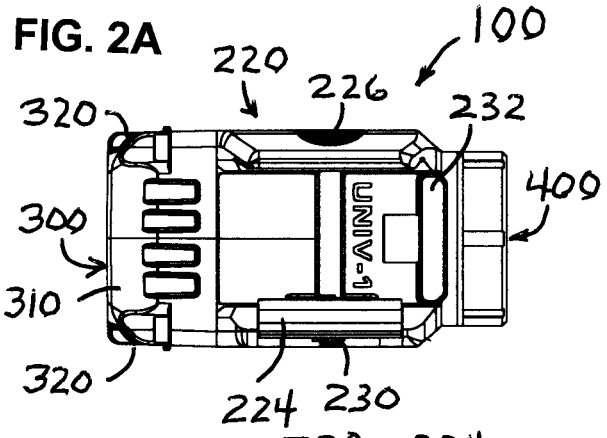
FIGS. 2A through 2F are six orthogonal views of the example light of FIGS. 1A through 1F.
Figure 2B:
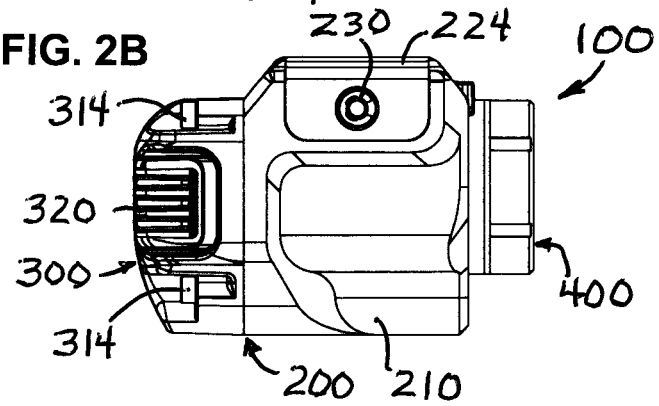
Figure 2C:
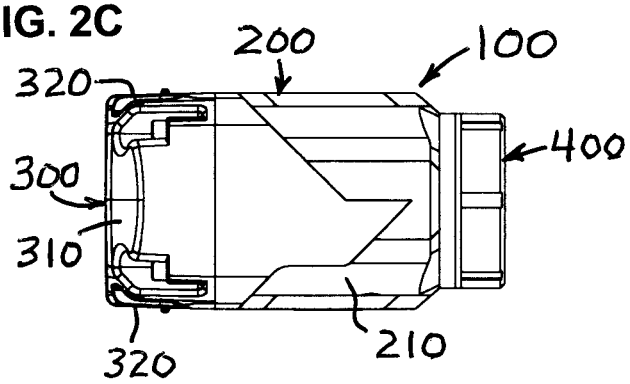
Figure 2D:
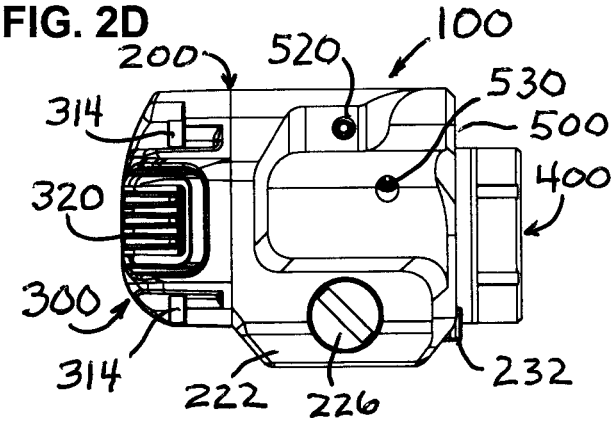
Figure 2E:
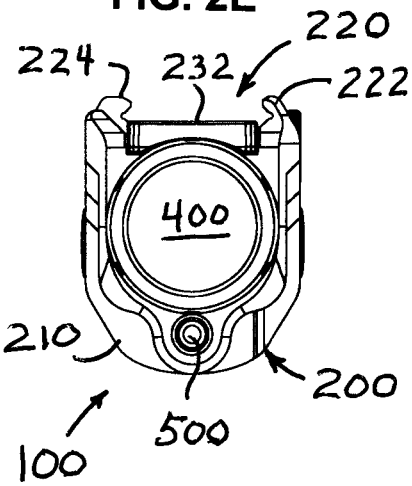
Figure 2F:
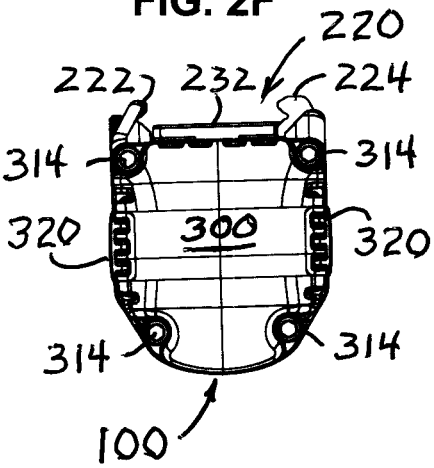
Figure 3A:
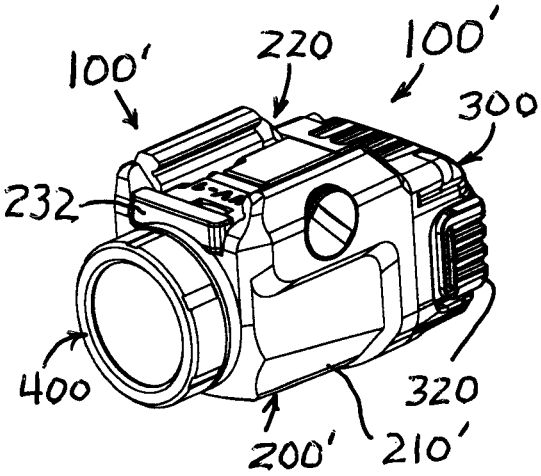
FIGS. 3A through 3F are perspective views of another example embodiment of a light that is mountable on a weapon.
Figure 3B:
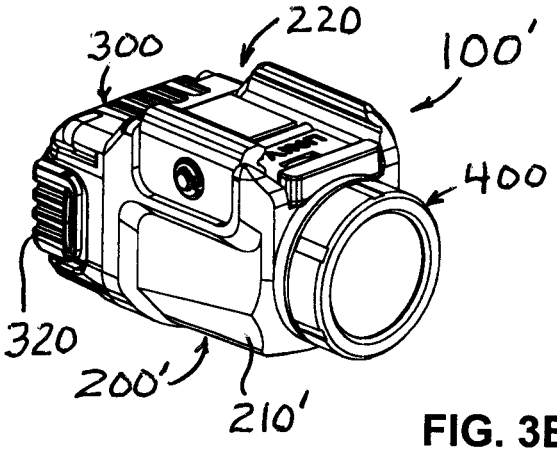
Figure 3C:
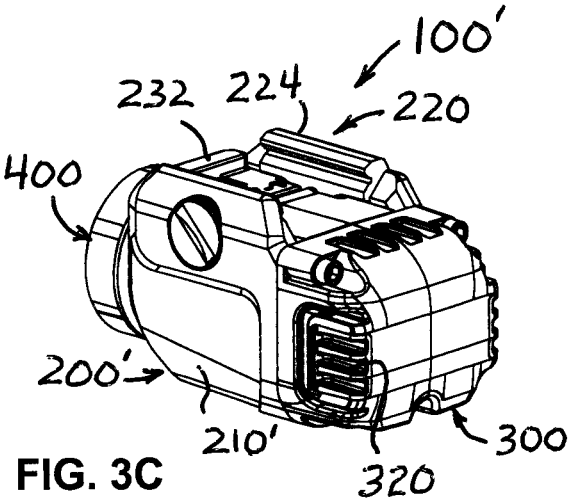
Figure 3D:
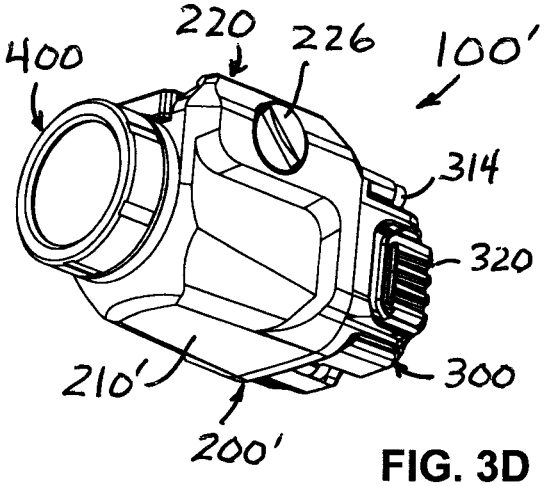
Figure 3E:
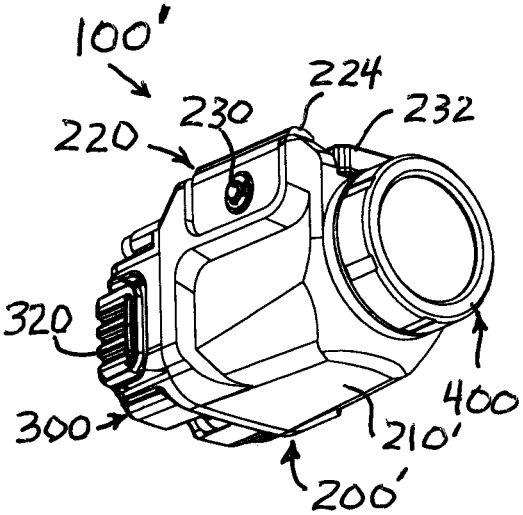
Figure 3F:
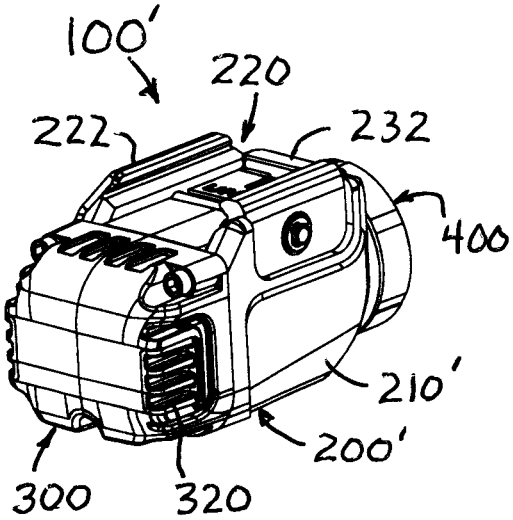
Figure 4A:
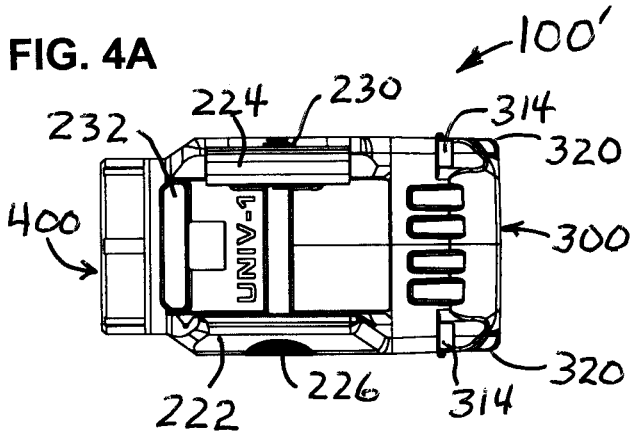
FIGS. 4A through 4F are six orthogonal views of the example light of FIGS. 3A through 3F.
Figure 4B:
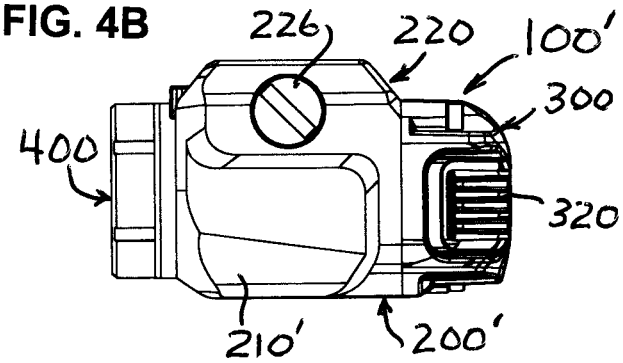
Figure 4C:
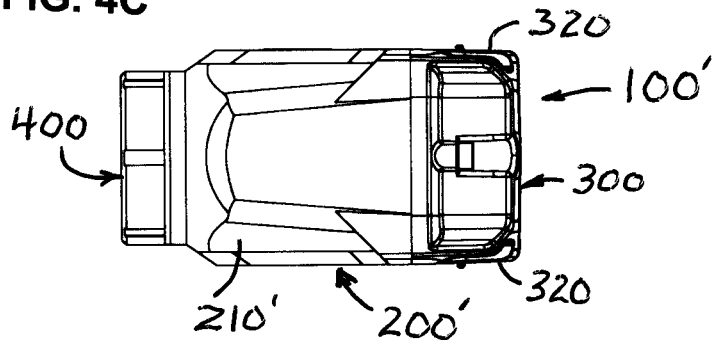
Figure 4D:
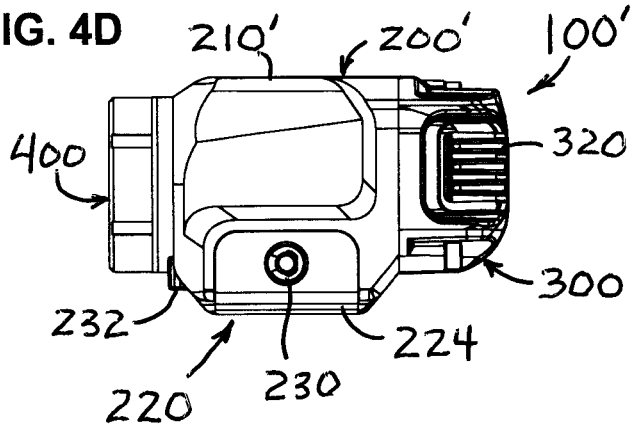
Figure 4E:
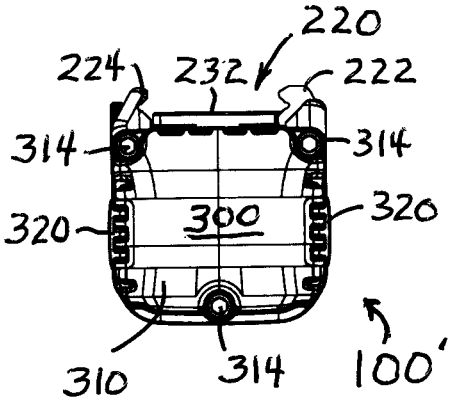
Figure 4F:
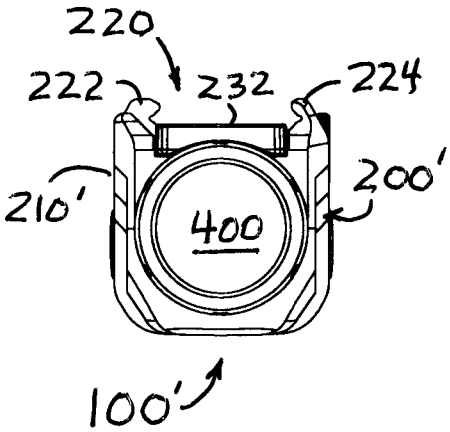

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

FIGS. 1A through 1F are perspective views of an example embodiment of a light 100 that is mountable on a weapon; FIGS. 2A through 2F are six orthogonal views of the example light 100 of FIGS. 1A through 1F; FIGS. 3A through 3F are perspective views of another example embodiment of a light 100' that is mountable on a weapon; and FIGS. 4A through 4F are six orthogonal views of the example light 100' of FIGS. 3A through 3F. Lights 100 and 100' are substantially similar except that light 100 has a laser light source 500, e.g., for aiming, whereas light 100' does not have a laser light source.

Accordingly, the common or substantially common features of each will be described first, followed by a description of the laser light feature of light 100. The numbers of items thereof that are not followed by a prime, e.g., light 100, are intended to include the corresponding items that are marked with a prime, e.g., light 100' unless otherwise stated.

Example lights 100, 100' each have a light body 200, 200' comprising a main housing 210, 210', a light source 400 at a forward end, and a tail cap assembly at a rearward end that includes actuators for electrical switches internal to light 100, 100' by which a user can control operation of the light 100, 100'. Because in the illustrated example lights 100, 100' are intended to be mountable on a weapon, e.g., on a mounting rail thereof, each has a mounting arrangement 220 or a mounting clamp 220 configured for gripping a mounting rail, however, a light needn't have a mounting clamp.

A mounting rail is typically attached to the underside of a weapon, e.g., to the bottom of a barrel thereof, and so mounting clamp 220 is normally at the top of light 100, 100' when it is mounted to a weapon, and so mounting clamp 220 is usually referred to as being at the top or upper end of light 100, 100'. While that orientation is used for ease of description, it does not limit the mounting or orientation in which a light 100, 100' may be utilized.

In the illustrated example, mounting clamp 220 has a fixed clamp member formed on main housing 210 that has a transverse hole through which a clamp screw 226 passes to threadingly engage a movable clamp member 224 so that rotating clamp screw 226 in one direction causes movable clamp member 224 to move closer to fixed clamp member 222, e.g., thereby to grip a mounting rail, and rotating clamp screw 226 in the opposite direction causes movable clamp member 224 to move away from fixed clamp member 222, e.g., to release the mounting rail.

Mounting arrangement 220 on light body 200 includes a fixed clamping member 222, a movable clamping member 224 and a clamp screw 226 connecting the two clamping members 222, 224. Preferably, a clamp screw spring 228 is provided for biasing the movable clamping member 224 to move towards fixed clamping member 222 whereby the light 100, 100' may be easily and conveniently mounted to a mounting rail of a weapon, e.g., by being snapped onto and off of the mounting rail. Optionally, but preferably, a retainer clip 230 is provided to prevent the inadvertent removal of clamp screw 226.

Also preferably, one or more interchangeable keying members 232 are provided for easily configuring light 100, 100' from fitting on one type of mounting rail to fitting on another, as when moving light 100, 100' from one type of weapon to another. Preferably interchangeable keying member 232 is disposed in a space between the clamp members 222, 224 and may be retained therein by a fastener, e.g., preferably by clamp screw 226. Light 100, 100' may be reconfigured for being clamped to mounting rails of different configurations by replacing keying member 232 with a different keying member 232 which has a like shaped and sized key body so as to all fit in the same space in light housing 210 between clamping members 222, 224, but that has a keying feature that is configured for mounting light 100, 100' on a particular mounting rail.

A detailed description of clamping arrangement 220 and of the elements thereof is found in U.S. Pat. No. 7,188,978 entitled "LIGHT MOUNTABLE ON A MOUNTING RAIL" and in U.S. Pat. No. 8,371,729 entitled "LIGHT WITH KEYING ARRANGEMENT MOUNTABLE ON A MOUNTING RAIL," each of which is assigned to Streamlight, Inc., of Eagleville, Pa., and is hereby incorporated herein by reference in their entireties.

Tail cap 300 is an assembly that is described in more detail below and is typically attached to light housing 210 by one or more fasteners 314. Tail cap 300 assembly has a tail cap housing 310 that includes one or more actuators 320, preferably two actuators 320 mounted at opposite sides of tail cap 300. By the use of either one or both of actuators 320, a user can cause the various light sources 400, 500 of light 100, 100' to produce and/or not produce one or more different kinds of light, e.g., white light, IR light and/or laser light, and to do so in one or more different operating modes, e.g., momentarily ON, continuously ON, flashing, blinking, strobing, dimming and un-dimming, OFF, and the like.

Light source 400 at the forward end of light 100, 100' typically produces a white light for illumination in a forward direction, e.g., in the same general direction that a weapon to which it is mounted is pointing. Typically the white illumination light produced by light source 400 is generally focused or formed into a relative narrow or spot beam, however, other beam forms may be provided, e.g., a wider or flood beam. In a preferred embodiment, light source 400 is a light source assembly including light producing devices, e.g., one or more light emitting diodes (LEDs), the circuitry for operating the light producing devices thereof, e.g., the one or more light emitting diodes (LEDs), optical elements, e.g., reflective and/or other optical elements, for forming the light produced by the LEDs into a desired beam, and mechanical structure for supporting the foregoing and for mounting light source assembly 400 to light housing 210.

In certain embodiments of light 100, 100' an infrared (IR) light source may also be included in light source assembly 400, typically emitting light through a hole or opening in the optical element for the illumination light source and in a substantially parallel forward direction to that of the usually centrally located main or white illumination light source.

Light 100 differs from light 100' in that light 100 includes a laser light source 500, e.g., for providing a generally coherent and very narrow beam of laser light that is configured to be emitted substantially parallel to the axis of the barrel of the weapon on which light 100 is mounted. Laser light source 500 includes a laser module mounted internally to main housing 210 in a manner that enables the axis of laser light to be precisely aimed in azimuth and in elevation so that it illuminates a target where a projectile shot from the barrel of the weapon will impact, at least at a certain distance or range of distances (the projectile does not travel in a straight line as does laser light, but in a parabolic arc).

Adjustment, e.g., aiming or bore sighting, of laser light source 500 is accomplished by two adjusting screws, e.g., one 520 for azimuth and one 530 for elevation. Because azimuth and elevation are perpendicular to each other, the azimuth and elevation screws are conventionally perpendicular to each other which means that the elevation adjustment is at the bottom of light 100 beneath laser light source 500 which tends to undesirably increase the size of light 100 in the vertical direction. The novel laser aiming arrangement herein that avoids that increased height is described in detail herein below.

Figure 5:
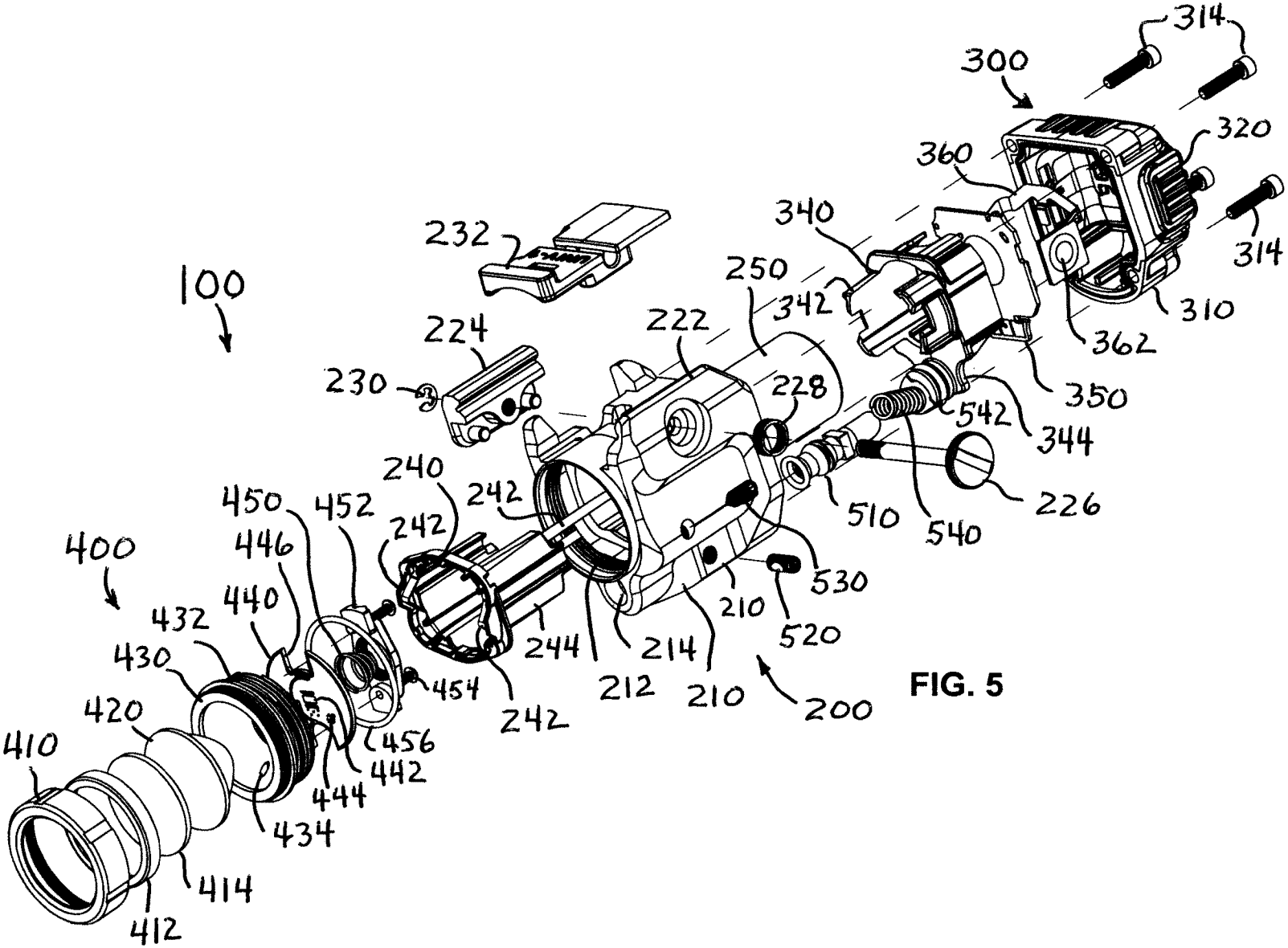
FIG. 5 is an exploded view of the example light of FIGS. 1A through 2F.
Figure 5A:
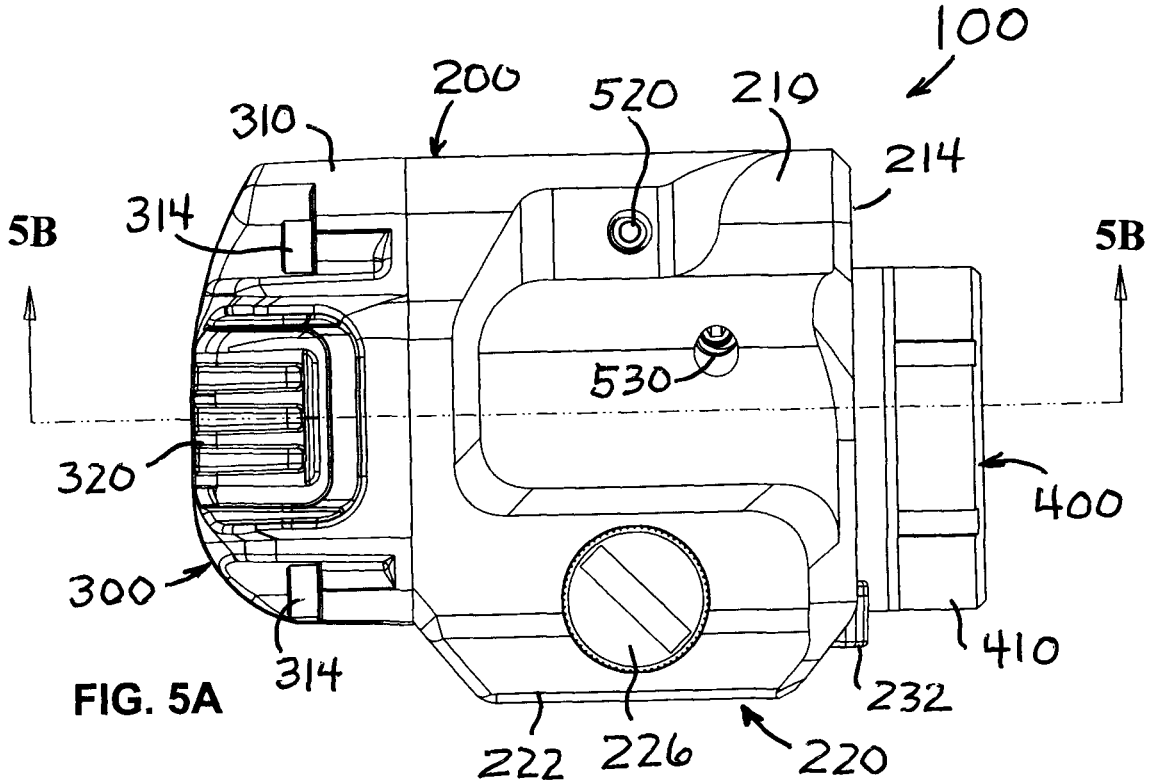
FIG. 5A is a side view thereof and FIG. 5B is a cross-sectional view thereof.
Figure 5B:
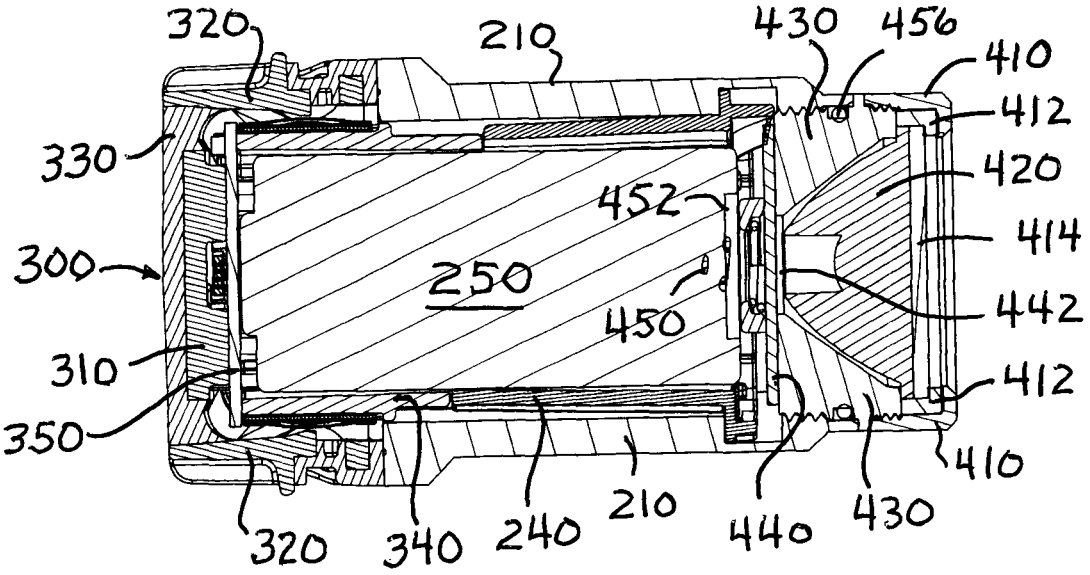
Figure 6:
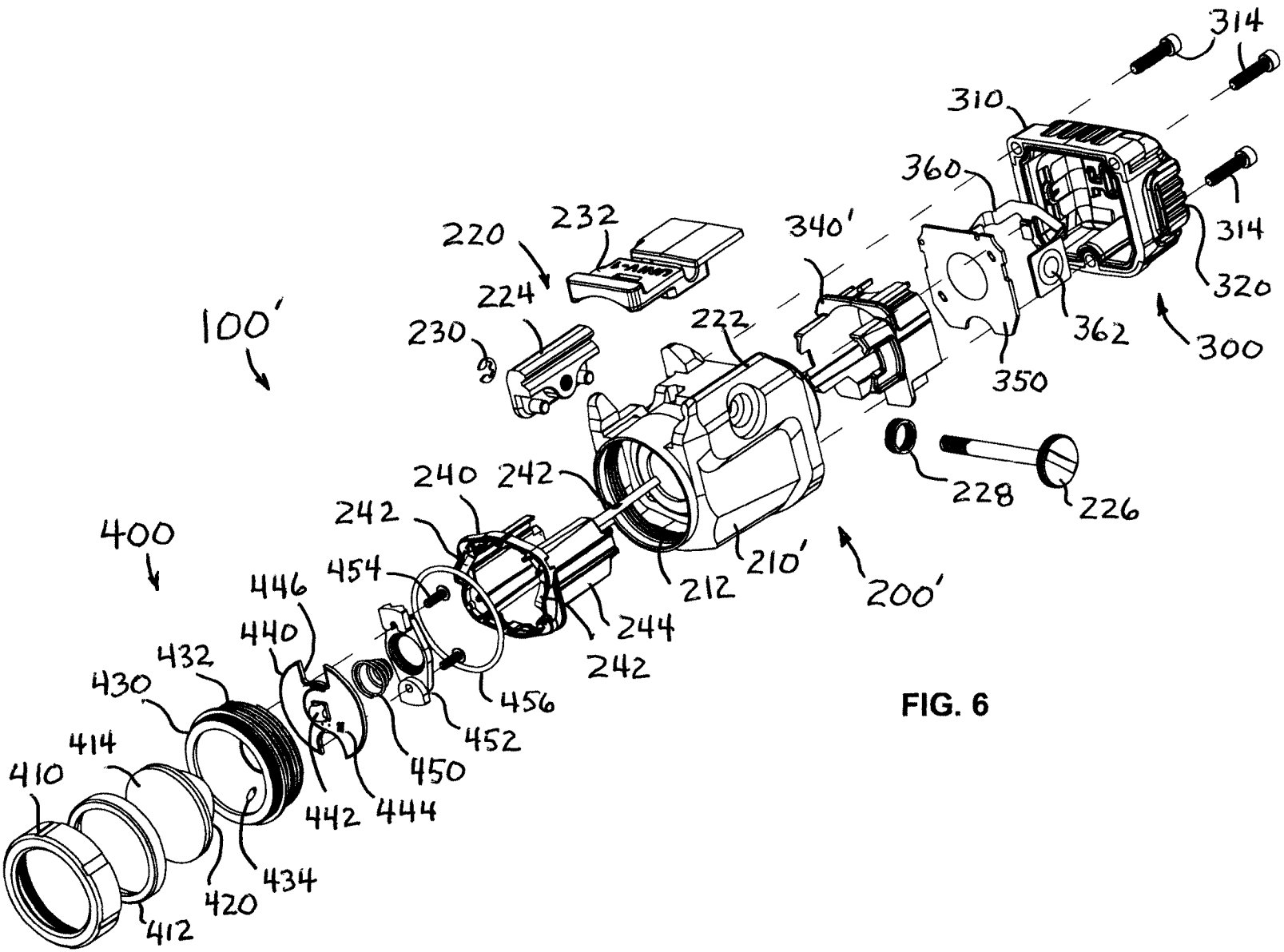
FIG. 6 is an exploded view of the example light of FIGS. 3A through 4F.
Figure 7A:
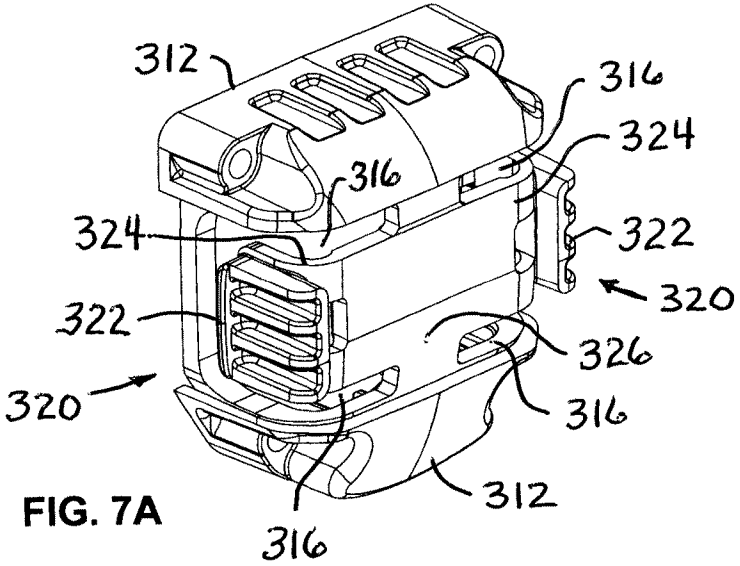
FIGS. 7A through 7D are perspective views of an example embodiment of a tail cap suitable for use with the light of the preceding Figures.
Figure 7B:
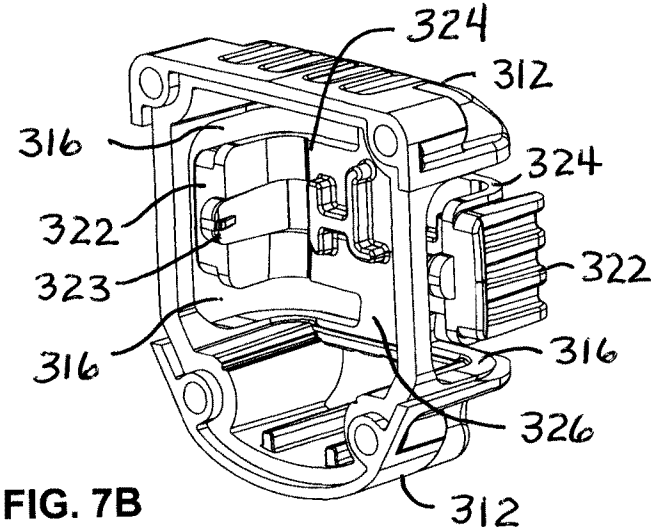
Figure 7C:
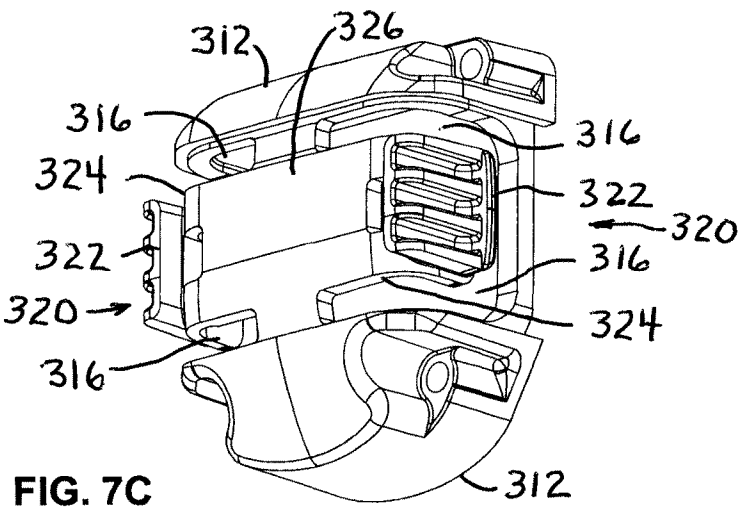
Figure 7D:
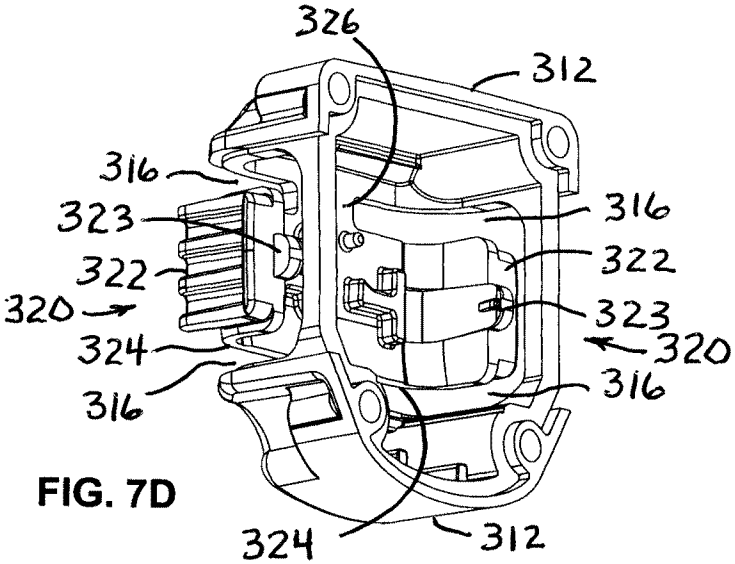

FIG. 5 is an exploded view of the example light 100 of FIGS. 1A through 2F, FIG. 5A is a side view thereof, and FIG. 5B is a cross-sectional view thereof; and FIG. 6 is an exploded view of the example light 100' of FIGS. 3A through 4F. Lights 100 and 100' are substantially similar, including at the cross-section of FIG. 5B, except that light 100 has a laser light source 500, e.g., for aiming, whereas light 100' does not have a laser light source. Accordingly, the common or substantially common features and elements of each, including internal structures, will be described first, followed by a description of the laser light feature of light 100 and its elements.

Light 100, 100' comprises a light body 200 including a main housing 210, a tail cap 300 at the rearward end of main housing 210, 210' and a light source assembly 400 at the forward end thereof. Light body 200 contains the operating elements of light 100 and has one or more internal cavities for receiving a source of electrical power 250, e.g., a battery 250, electrical circuitry, e.g., on circuit boards 440, 350, 360, and a light source 400, typically a white light source for illumination, and in the case of light 100 a laser light source 500, and in both examples one or more elements of internal structure for the foregoing.

Main housing 210, 210' defines an internal cavity for receiving power source 250, which is preferably replaceable, e.g., removed and installed, from the forward end 212 of main housing 210, 210'. Replacement of battery 250 is preferably accomplished by removing light source assembly 400, e.g., by rotating light source assembly 400 to unscrew it from the threads at opening 212.

Preferably, main housing 210, 210' also includes a mounting clamp 220 including a fixed clamp member 222 on main housing 210, a movable clamp member 224 and a clamp screw 226 for moving clamp member 224 nearer to and farther away from fixed clamp member 222 thereby to grasp and release light 100 from a mounting rail.

A biasing spring 228 between fixed clamp member 222 and the head of clamp screw 226 preferably biases clamp screw 226 such that movable clamp member move toward clamp member 222, and a retainer 230, e.g., a C-clip 230, preferably prevents unintentional removal of clamp screw 226 from mounting clamp 220 of light 100, 110'.

Also preferably, one or more interchangeable keys 232 are provided that have a key body of like shape and size so as to fit into the space between fixed and movable clamp members 222, 224 and that have keying features of different sizes and shapes on the key body configured to properly interface with and engage mounting rails of different configurations. However, a fixed key may be provided, rather than an interchangeable key 232.

In the case of light 100, main housing 210 includes a receptacle or tunnel 214 at the bottom thereof for receiving laser light source 500 therein. Laser light source 500 preferably includes a laser module 510 that produces laser light, one or more adjusting elements 520, 530, e.g., one for azimuth and another for elevation, and a biasing spring 540 therefor.

Tail cap assembly 300 comprises a housing 310 that is attached to the rearward end of housing 210, e.g., by fasteners 314, and is formed to define one or more actuators 320 configured to actuate one or more electrical switches 360, 362 located internal to light body 200 when an actuator 320 is pressed. A flexible circuit board 360 internal to light body 200 is attached to circuit board 350 and electrically connects the one or more electrical switches 262, e.g., snap dome switches 362, on flexible circuit board 360 to circuit board 350, e.g., to control circuitry on circuit board 350.

Internal frame 340, 340' is a structure internal to light body 200 that supports the electrical circuit board 350 on which may be provided various electronic and electrical parts for responding to actuation of switches 362 for controlling the operation of light 100, 100', e.g., for controlling the operation of light sources 400 and 500 thereof. Internal frame 340 in the case of light 100 includes a support structure 344 on which biasing spring 542 for laser light source 500 is supported. Internal frame 340 may also include one or more guides 342, e.g., one or more arcuate or curved guide walls 342 where battery 250 is cylindrical, configured for defining the cavity for and/or locating battery 250 inside light body 200.

Mode selecting light source assembly or module 400, which may also be referred to as a mode selecting face cap module or assembly, comprises a face cap 410 having internal threads and a heat sink 430 having external threads 432 onto which face cap 410 is threadingly attached, and preferably retained, and for threadingly attaching light source assembly 400 into main housing 210, 210'. Threading face cap 410 onto heat sink 430 serves to retain seal 412, lens 414 and reflective element 420, e.g., a reflector 420, and preferably a totally internally reflective (TIR) optical element 420, therebetween. Seal 412 provides a seal between face cap 410, lens 412 and heat sink 430 and O-ring 456 provides a seal between heat sink 430 and main housing 210, 210'. Lens 414 is preferably a glass lens 414.

TIR element 420 is preferably behind a lens, e.g., a glass lens, and is of an optically clear plastic having a substantially flat forward face from which light is emitted, having curved sides which may be spherical or aspherical. A recess at the rear thereof received light from LED 442 and may have a cylindrical surface wall with a convex interior end, as may be desired for receiving light from LED 442 with suitable optical efficiency and forming a light beam of a desired beam width and dispersion therefrom.

At the rearward end of heat sink 430 is a contact spring 450 extending rearwardly from light source assembly 400 for making an electrical contact with power source 250 in main housing 210, 210'. Contact spring 450 is retained in a central location, e.g., on a longitudinal axis of light body 200 and preferably aligned with power source 250, by spring retainer 452 which is attached to the rearward end of heat sink 430, e.g., by fasteners 454. A light emitting diode (LED) 442 is centrally located on LED circuit board 440 which is retained between spring retainer 452 and heat sink 430 so as to be aligned with the optical axis of reflective element 430 whereby light produced by LED 442 is formed into a forwardly directed beam of light having desired characteristics.

LED circuit board 440 preferably has one or more features 446, e.g., one or more notches 446 at the periphery thereof, that cooperate with corresponding features of contact spring retainer 452, e.g., raised areas at the opposing ends thereof, so that the relative orientations of LED circuit board 440 and LED 442 thereon are fixed upon assembly, e.g., in cooperation with fasteners 454, for producing the desired beam of light.

Optionally, a further LED 444, e.g., an IR LED 444 or any other desired LED 444, may be provided on LED circuit board 440 at a predetermined radial position and angle relative to the longitudinal axis, e.g., the optical axes of LED 442 and optical element 420, so as to emit light that passes through opening 434 in heat sink 430 to be emitted forwardly through optical element 420 and lens 414.

Contact retainer 240 having one or more electrical contacts 242 in predetermined positions is provided in the threaded forward opening of main housing 210. Contacts 242 cooperate with one or more conductive regions on the rearward surface of LED circuit board 440 where light source assembly 400 is a mode selecting light source assembly 400. In the illustrated example, a pair of electrical contacts 242, e.g., contact springs 242, are positioned about 180° apart on the forward periphery of contact retainer 240. Contact springs 242 are preferably formed of an elongated strip of springy metal, e.g., a copper, brass, or beryllium copper, and extend rearwardly into the interior of main housing 210 where they directly or indirectly make electrical contact with, and/or may be soldered to, control circuit board 350 for connecting LED 442, and optionally LED 444, thereto via LED circuit board 440 for respectively being energized to produce light.

Contact retainer 240 which is retained within main housing 210, preferably has one or more guides 244, e.g., arcuate or curved guide walls 244 where power source 250 is cylindrical, for aiding in locating power source 250 within light body 200. Contact retainer 240 and internal frame 340 cooperate, e.g., the respective guide walls 244, 342 thereof cooperate, to position power source 250, e.g., battery 250, in a desired location within light body 200.

Operation of the mode selecting feature of light source assembly 400 is described below, it being noted that the threads 432 of heat sink 430 and the threads 212 of main housing 210 are "clocked" or registered, i.e. are in predetermined rotational registration so that each heat sink 430 when fully threaded into main housing 210 stops at the same predetermined radial angle, whereby the orientation of light source module 400 with contacts internal to main housing 210 is predetermined.

Figure 9A:
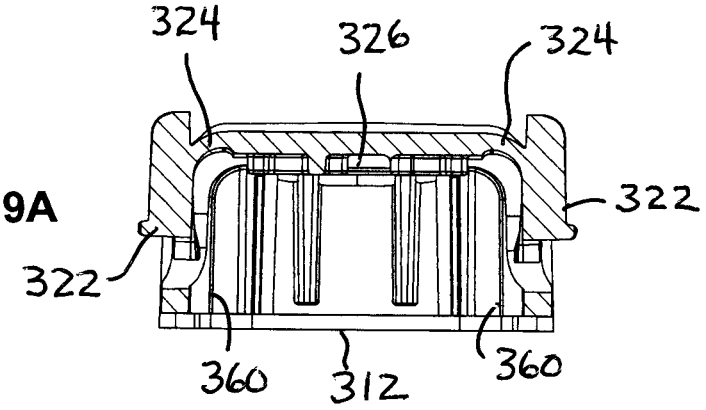
FIGS. 9A and 9B are respective cross-sectional views thereof in the two different planes.
Figure 9B:
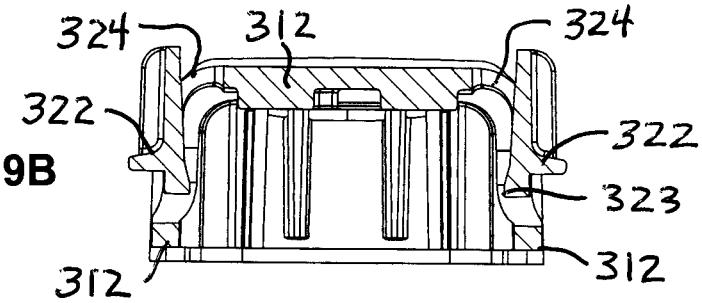
Figure 9:
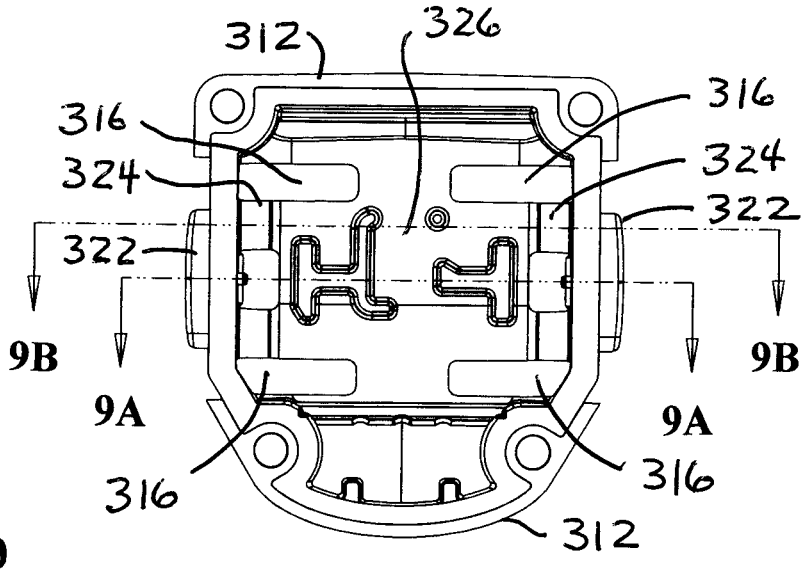
FIG. 9 is a view of the internal end of the example embodiment of a tail cap of FIG. 8 without the over-molded material.

FIGS. 7A through 7D are perspective views of an example embodiment of a tail cap 300 suitable for use with the light 100 and/or 100' of the preceding Figures, FIG. 8 is a view of an internal end of the example embodiment of the tail cap 300 which includes an over-molded material 330, and FIGS. 8A and 8B are respective cross-sectional views thereof in two different planes; FIG. 9 is a view of the internal end of the example embodiment of a tail cap 300 of FIG. 8 without the over-molded material 330, FIGS. 9A and 9B are respective cross-sectional views thereof in the two different planes; and FIG. 10 is a perspective view of an example embodiment of a circuit structure 360 providing electrical contacts 362 that cooperate with the example tail cap 300 of FIGS. 7A through 9B.

Tail cap assembly 300 includes a housing shell 312 which is of a relatively rigid material, e.g., a nylon or other plastic that provides actuator 320. Housing shell 312 has a generally rectangular periphery through which are plural holes for receiving fasteners 314 that attach tail cap assembly 300 to main housing 210 and has a central support or member 326 connecting at both ends to the periphery, all of which is relatively rigid, e.g., due to material, configuration and thickness. Housing shell 312 has, e.g., one or more long U-shaped openings 316 having their ends at central support 326 to define one or more cantilevered supports 324 each having an actuator part 322 or paddle 322 at the distal end thereof that together provide the actuator 320 that is actuatable from outside of light 100, 100'.

Cantilevered from the central support 326 in the opening defined by U-shaped slot 316 is a relatively flexible cantilevered support 324 that has a relatively rigid actuator part 322 supported at an end of cantilevered support 324 that is distal from central support 326. Cantilevered support 324 preferably extends outwardly from central support 326 to the side of housing shell 312 and then bends around to extend along the side of housing shell 312. Actuator part 322 is relatively thicker so as to be relatively rigid whereas cantilevered actuator support 324 is relatively thinner so as to be relatively flexible relative to actuator part 322 and central support 326.

Each of cantilevered supports 324 is L-shaped with a longer part thereof extending from the central part 326 of the housing shell 312 and with a shorter part thereof extending along one of the side surfaces. The actuator 322 extends from the distal end of the shorter part of the L-shaped cantilevered support 324 along the one of the side surfaces in a direction toward the connecting surface of central support 326.

As a result, pressing on actuator part 322, whether in a direction from the side of tail cap assembly 300 or from the rear thereof, causes actuator part 322 to move inward, e.g., toward the interior of tail cap assembly, as cantilevered support 324 flexes or bends. As actuator part 322 is pressed and moves inward as cantilever support 324 bends, raised part 323 of actuator part 322 contacts and presses against switch 362 which is disposed inside tail cap assembly 300 adjacent to actuator part 322. Switch 362 is thereby actuated to close, e.g., the snap dome switch element 362 thereof bends to make contact between two electrically conductive areas that lie beneath the snap dome element 362. When actuator part 322 is released it returns to its un-actuated position due to the resiliency of cantilever support 324, whereby switch 362 is also released and snap dome switch 362 thereof de-actuates and switch 362 opens.

In a preferred embodiment, a flexible circuit board 360 has a central contact pad 366 that is attached to and electrically connects with control circuit board 350. Extending from contact pad 366 are a pair of flexible arms 364 at the end of which are enlarged parts on which are mounted respective flexible snap dome switches 362. Snap dome switches 362 may be attached thereto by soldering, by electrically conductive adhesive, and/or by a thin adhesive tape cover. Flexible arms 364 have a shape that when bent to be placed inside of tail cap housing shell 312 place switches 362 adjacent to actuator part 322 and the raised part 323 thereof. In the illustrated example flexible arms 364 diverge from the central contact pad 366 so as to extend to opposite sides of tail cap 300. Internal frame 340, 340' when assembled with tail cap assembly 300 is adjacent to the rear side of switches 362 thereby to provide support so that switches 362 do not move inwardly when actuator 320 is pressed, whereby switches 362 are actuatable by actuator 320.

Electrically, a pair of electrical conductors on flexible circuit board 360 extend along each of the diverging flexible arms 364 from the respective snap dome switches 362 to central contact pad 366. Preferably the conductors for switches 362 do not electrically connect with each other so that each switch 362 may be independently connected to control circuit board 350 and may operate independently, e.g., for increasing the options for programming the control circuitry on circuit board 350 can be programmed by using one or both of switches 362.

Housing shell 312 is over-molded with a flexible and resilient plastic material 330 that is over molded to fill the U-shaped slot 316 thereby to seal tail cap assembly 300 while retaining the flexibility of cantilevered supports 324 to move when actuator parts 322 are pressed as described. In addition, it is also desirable that the material of which housing shell 312 is formed be relatively structurally strong while the material of over molded member 330 is relatively soft, resilient and/or flexible to facilitate easy movement of actuator button 320, 322 when pressed. In addition, the materials of housing shell 312 and molded member 330 are preferably resistant to the oils and solvents usually used for cleaning and maintaining a weapon.

The combination of materials for housing shell 312 and over molded insert 330 are preferably selected so that over molded insert 330 is "molecularly bonded" or "chemically bonded" to housing shell 312, thereby to from a permanent and rugged seal. Housing shell 312 can be formed of polypropylene, polycarbonate, nylon, engineered nylon, Nylon 6, polyester-polycarbonate blends and ABS polycarbonate blends (such as LEXAN® polycarbonate, XENOY polyester-polycarbonate blend and CYCALOY ABS polycarbonate blend). Housing shell 312 may also be a thermoplastic nylon or other elastomeric plastic such as that sold under the trademarks CAPRON® and NYPEL® or a thermoplastic elastomer compound or thermoplastic vulcanizate sold under the trademark Nylabond®. The foregoing materials are commercially available from many distributors and suppliers.

Over-molded material 330 may be, e.g., a silicone, urethane, rubber, soft rubber, thermoplastic elastomer (TPE) or other flexible and resilient material, and preferably is a material that tightly bonds to the material of housing shell 312. Example materials include a thermoplastic elastomer (TPE) such as MONOPRENE® rubber, a thermoplastic vulcanizate (TPV) such as nylon-bondable SANTOPRENE rubber, or HERCUPRENE rubber. SANTOPRENE rubber, for example, chemically bonds to nylon 6, glass-reinforced nylon 6 and blends of nylon 6 and nylon 6/6 without requiring a primer that would complicate the two-step molding process for molding housing shell 312 and then over molding resilient insert 330 thereto. The foregoing materials are commercially available from various distributors and suppliers.

As a result, tail cap assembly 300 is a versatile, convenient to use feature of light 100, 100' and may be aesthetically enhanced by the texturing and/or coloring of the materials of housing shell 312 and of over-molding material 330.

Figure 11:
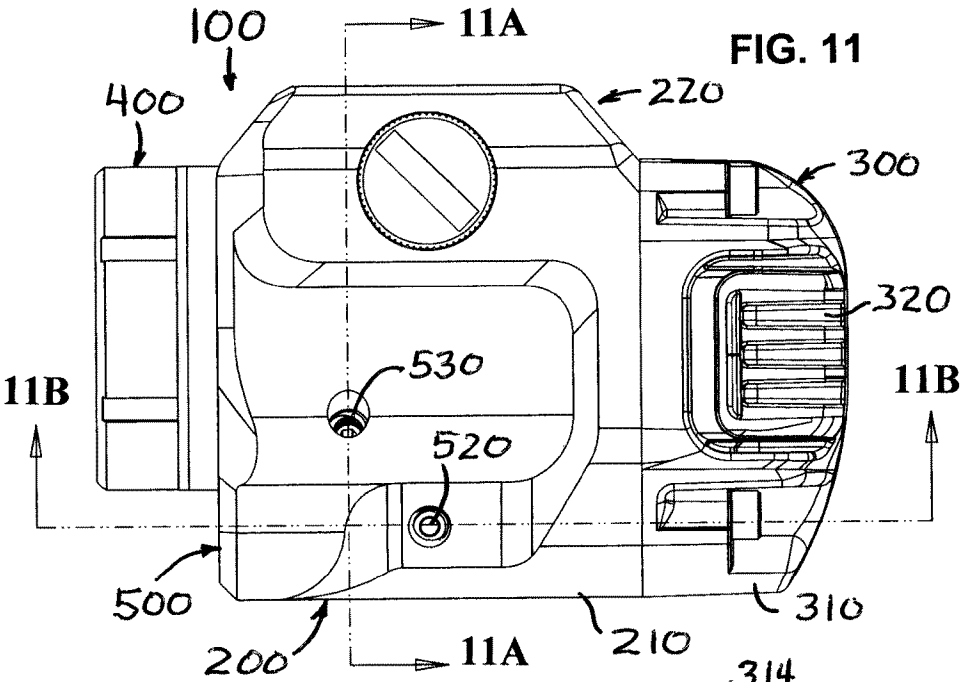
FIG. 11 is a side view of the example light.
Figure 11B:
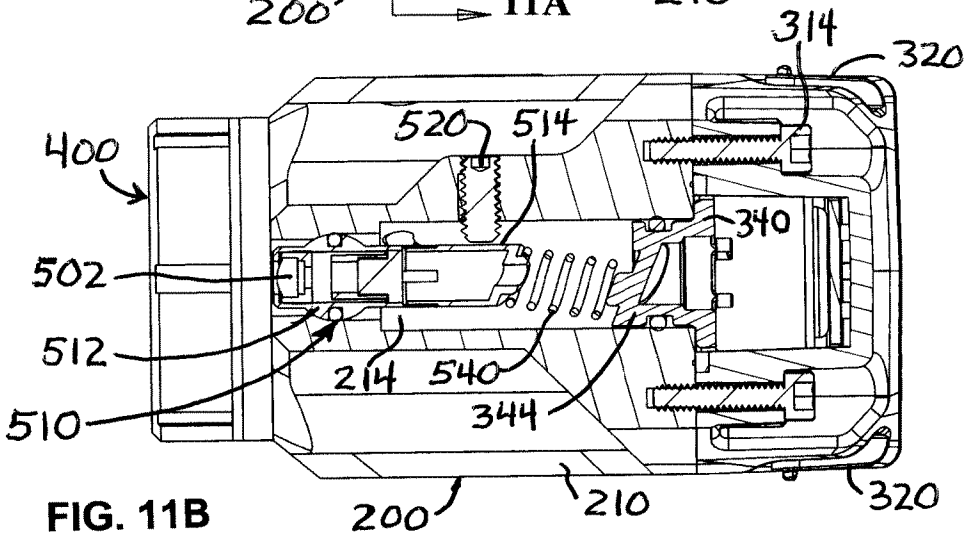
FIGS. 11A and 11B are respective cross-sectional views thereof in two different planes.
Figure 11A:
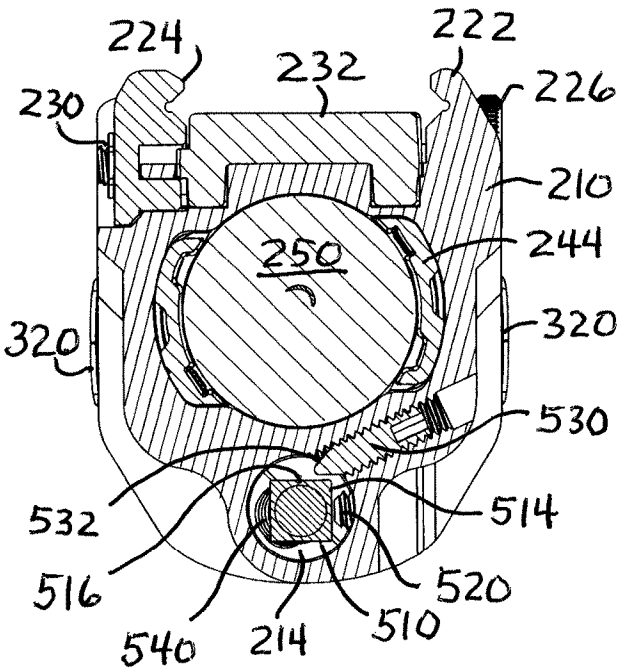

FIG. 11 is a side view of the example light 100, and FIGS. 11A and 11B are respective cross-sectional views thereof in two different planes; and FIGS. 12A and 12B are perspective views of an example laser light source 500 suitable for use with the example arrangement of FIGS. 11 through 11B. Laser light source module 510 therefor includes, e.g., a laser diode for producing laser light that is contained in a housing that has a generally spherical or otherwise curved forward end 512 for being seated in a correspondingly shaped forward end of the receptacle 214 of housing 210 so as to pivotably movable therein, at least to the extent necessary for moving the laser module 510 sufficiently horizontally and vertically, e.g., in azimuth and elevation, to align or bore sight the laser light produced thereby with the trajectory of a projectile fired from the weapon. Preferably, forward end 512 has a circumferential groove 513 therein in which a resilient O-ring is disposed, e.g., for maintaining a position of laser module 510 and for cushioning and/or sealing.

Laser module 510 also has first and second orthogonal surfaces 514, 516 against which force may be applied for independently adjusting, e.g., azimuth and elevation. In the present arrangement, at least one of those surfaces, e.g., surface 516, should be a flat surface, although surface 514 and/or other surfaces of the housing of laser module may be flat. A pair of electrical leads 518 extends from laser module 510 for applying electrical power thereto for energizing the laser source, e.g., a laser diode, internal thereto.

In the following description of the aiming and/or adjustment of laser module 510 of laser light source 500, light 100 is deemed to be mounted in the usual manner under the barrel of a weapon and to be attached thereto by mounting clamp 220. Thus, vertical is a direction passing through light 100, e.g., from bottom to top through laser receptacle 214 and through mounting clamp 220, as is the cross-section 11A-11A, and horizontal is the orthogonal direction, e.g., from side to side, as is cross-section 11B-11B. Accordingly, up is vertically towards clamp 220 while down is vertically away from mounting clamp 220, while left and right are side to side as viewed looking into the forward end of light 100.

Laser module biasing spring 540 supported on a support 344 of internal frame 340 is angled both vertically and horizontally to have its axis extend in a forward, upward and rightward direction therefrom to bear against laser module 510 and to bias laser module 510 to move in both an upward and a rightward direction while forward end 512 is seated in receptacle 214. The upward and rightward movement of laser module 510 is restrained, however, by adjustment screws 520, 530 which bear against the side and top of laser module 510, and the forward movement thereof is restrained by curved forward surface 512 being seated in the corresponding forward surface of receptacle 214 of main housing 210.

Two aiming adjustment screws 520, 530 are provided for adjusting the beam of laser light produced by laser module 510 in two orthogonal directions, e.g., in azimuth and elevation, respectively, relative to light 100 and light body 200, and when light 100 is mounted to a weapon, relative to the weapon.

Azimuth adjusting screw 520 is threaded into a threaded hole in the side of light body 200 which is substantially horizontal when light 100 is mounted to a weapon in the usual manner. Adjustment screw 520 preferably has a substantially flat forward end that bears against the side of laser module 510, e.g., on vertical surface 514 or elsewhere along the right side thereof in the plane of the central axis thereof. Rotating azimuth adjustment screw 520 to move inwardly pushes laser module 510 to the left against the rightward bias of spring 540, and rotating azimuth adjustment screw 520 to move outwardly allows laser module 510 to move rightward under the bias of spring 540. Thus screw 520 adjusts azimuth to the right and to the left, with laser module being maintained in an adjusted position by curved forward part 512, the rightward bias of spring 540 and adjustment screw 520.

Conventionally, a vertically oriented elevation adjustment screw is provided beneath laser module 510, i.e. in a threaded vertical hole, to move it upward against a downward spring bias. Such arrangement necessitates that additional material be provided on the light body beneath the laser module so that the elevation adjustment screw can be provided therein. This necessarily and undesirably increases the vertical dimension of the light. The laser adjustment arrangement herein avoids the need for such additional material and does not increase the vertical dimension of the light.

Elevation adjustment screw 530 is threaded into a threaded hole in the side of light body 200 that is angled relative to horizontal (azimuth) at an acute angle so that the preferably conical forward end of adjustment screw 530 is substantially tangent to flat surface 516 of laser module 510, with surface 516 being substantially horizontal. Because of the angled forward end, rotating elevation adjustment screw 530 produces a substantially vertical force on surface 516 of laser module 510 so that it moves substantially vertically, and substantially independently of azimuth. In this arrangement, the height of light body 200 need not be increased to accommodate the elevation adjustment screw.

Rotating elevation adjustment screw 530 to move inwardly pushes laser module 510 downwardly against the upward bias of spring 540, and rotating elevation adjustment screw 530 to move outwardly allows laser module 510 to move upward under the bias of spring 540. Thus screw 530 adjusts elevation upward and downward, with laser module 510 being maintained in an adjusted position by curved forward part 512, the rightward bias of spring 540 and adjustment screw 530.

Elevation adjustment screws 520, 530 may be standard set screws, one with a flat forward end and the other with a conical forward end. Typically, standard set screws of a given size, e.g., a #4 or #6 set screw, will have the same thread pitch. A hexagonal recess in the opposite ends thereof allows for easy adjustment using a hexagonal or Allen wrench. In that instance, however, because elevation adjustment screw 530 is at an angle with respect to surface 516 of laser module 510, each rotation thereof will produce a smaller vertical movement of the forward end thereof which will produce a smaller angular change in the elevation of the laser aiming beam than will each rotation of azimuth adjustment screw 520 produce in azimuth.

In a preferred example arrangement, elevation adjustment screw 530 has a greater thread pitch (i.e. fewer threads per inch) than does azimuth adjustment screw 520 so that each rotation of elevation adjustment screw 530 will produce about the same angular movement of the laser aiming beam in elevation as does each rotation of azimuth adjustment screw 520 produce in azimuth. Also in that example arrangement, the elevation screw threaded hole is at an about 25° angle from horizontal and so the conical tip of elevation adjustment screw 530 will have an included apex angle of about 50° or about two times the angle of its threaded hole, so that its conical surface is substantially parallel to surface 516 of laser module 510.

The angular movement of azimuth and elevation per rotation of azimuth and elevation screws 520, 530 is related to the distance from the forward end 512 of laser module 510 whereat azimuth and elevation screws 520, 530 are located. Azimuth and elevation screws 520, 530 will each have a higher sensitivity (angular movement per screw rotation) if it is closer to the forward end 512 and have a lesser sensitivity if it is farther from the forward end 512.

Figure 13:
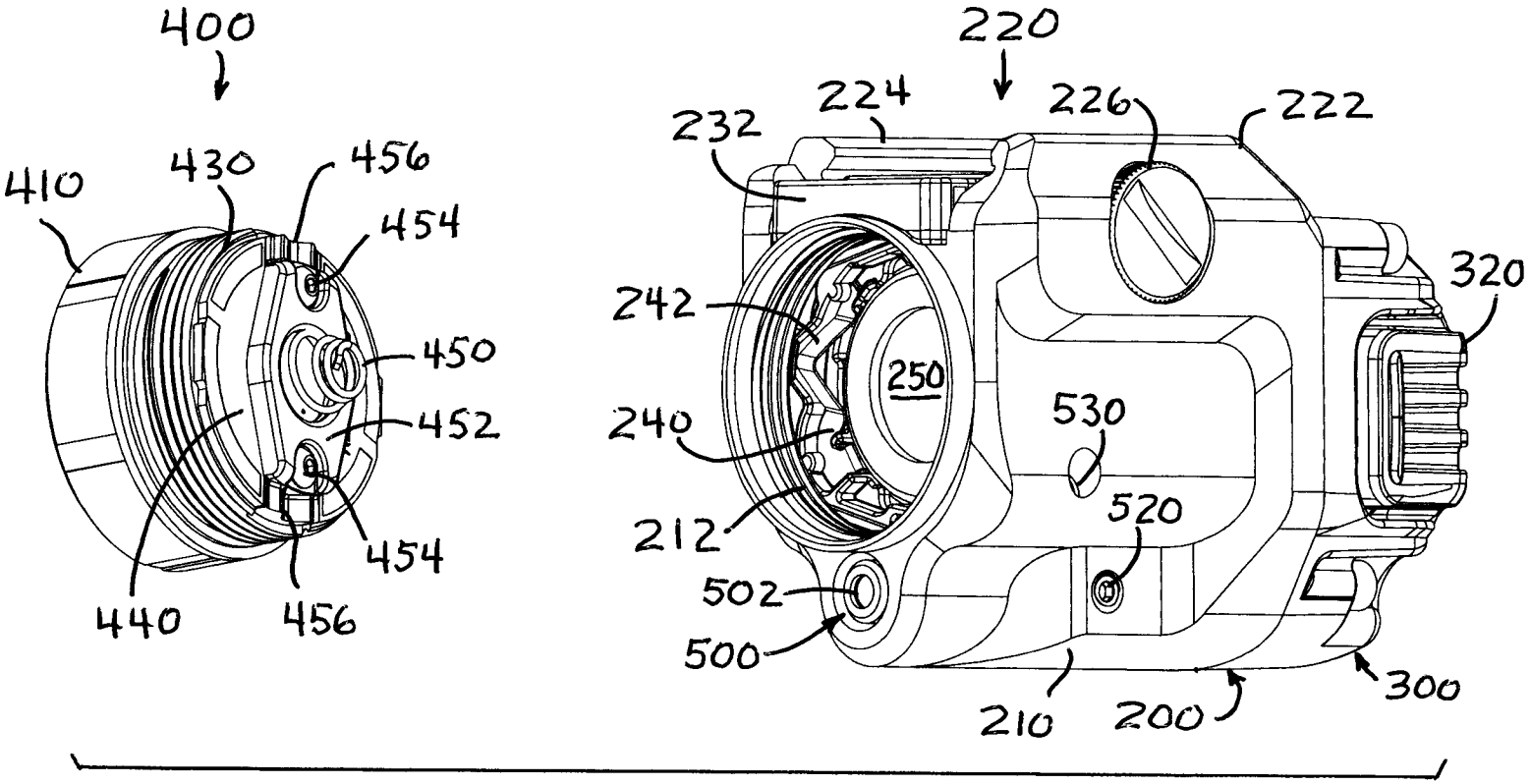
FIG. 13 is a perspective view of the example light of FIGS. 1A through 6 with the example light source assembly separated from the light body thereof.
Figure 14:
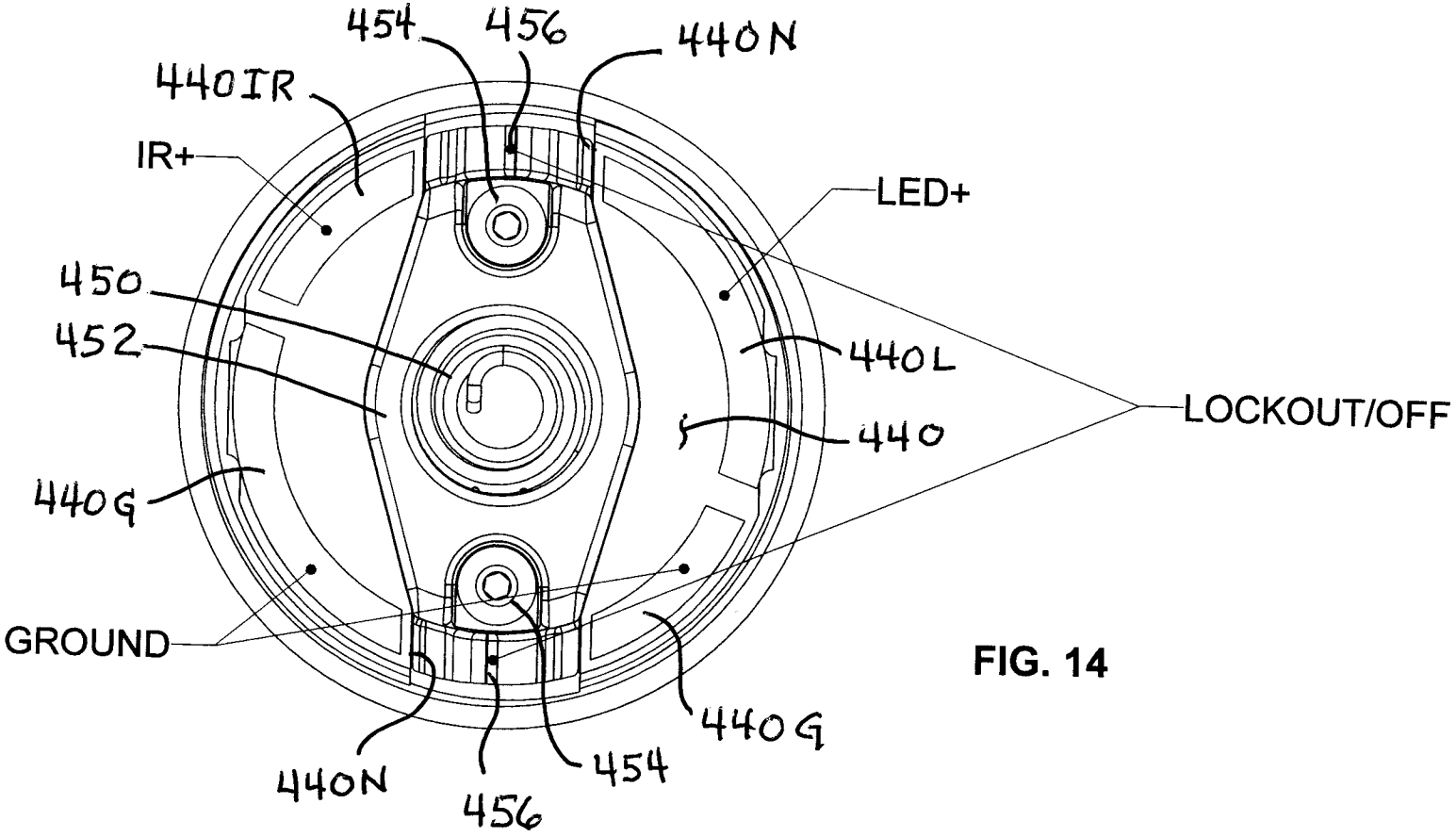
FIG. 14 is an enlarged view of the inner end of the example light source assembly of FIG. 13.

FIG. 13 is a perspective view of the example light 100 of FIGS. 1A through 6 with the example light source assembly 400 separated from the light body 200 thereof and FIG. 14 is an enlarged view of the inner end of the example light source assembly 400 of FIG. 13. Therein is seen the arrangement of spring contacts 242 and the negative end of battery 250 within opening 212 of light body 200 and main housing 210 thereof, as well as the arrangement of mode selecting light source assembly 400 including heat sink 430, face cap 410, battery (spring) contact 450, spring retainer 452 and fasteners 454, and the arrangement thereof.

Each spring contact 450 (only one is visible in FIG. 13) is preferably formed to have a forwardly projecting V-shape with the apex thereof positioned to contact the rear of mode selecting light source assembly 400, e.g., near the periphery thereof, when that assembly 400 is installed (threaded into) the forward opening 212 of main housing 210 of light body 200.

As described, each spring contact 242 is supported on contact retainer 240 in a position to make physical contact with mode selecting light source assembly 400 when that assembly 400 is installed (threaded into) the forward opening 212 of main housing 210 of light body 200. As previously described, the respective threads of opening 212 and of light source module 400 are "clocked" so that any light source module 400 when fully threaded into opening 212 of any light body 200 will be in a predetermined rotational orientation relative thereto, e.g., as will be the lockout feature 456 thereof and the conductive areas 440G, 440IR, 440L of circuit board 440.

Circuit board 440 (except for conductive contact areas 440G, 440IR and 440L thereon, and other printed circuit features) is electrically insulating as is contact retainer 452 and light body 200. Preferably, contact retainer 450 and circuit board 440 are formed of an electrically insulating material, such as an FR4 fiberglass material, an engineered nylon, or another plastic.

Typically, example circuit board 440 has a circular periphery, at least in part, and may have one or more notches 440N, e.g., located about 180° apart near the periphery of circuit board 440, that are configured to receive parts, e.g., raised parts, at the opposing ends of spring contact retainer 452 so that circuit board 440 and the electrically conductive regions thereon are in a predetermined angular position relative to heat sink 430 and the threads thereof, and relative to contact retainer 452 and electrical contacts 242, and are retained thereat by fasteners 454.

Mode selecting light source assembly 400 also has one or more raised and/or recessed features 456, e.g., lockout seats 456, that engage contact springs 242 not for making electrical contact, but for providing a detent resisting rotation of mode selecting light source module relative to light body 200. This feature, often referred to as a lockout position, which corresponds with all of the light sources of light 100, 100' being OFF, i.e. not energized, provides a safety feature when light 100, 100' is utilized in situations and/or conditions where inadvertently turning any light source of light 100, 100' ON would compromise secrecy or give away position or other practical or tactical information, as well as reducing the likelihood that light 100, 100' will turn on when packed, e.g., in luggage or other places.

Rotating mode selecting light source module 400 in a direction to remove it from light body 200, e.g., counter-clockwise, by up to about 15-55° from the lockout detent position, brings the infrared (IR) light source conductive area 4401R and a ground conductive area 440G that is about 180° removed therefrom into electrical contact with a respective one of the two contact springs 242, whereby the IR light source 444, if any, in light source module 400 is connected to the control circuitry of light 100, 100', e.g., on control circuit board 440, so as to be energizable responsive to actuation of either or both of actuators 320.

Rotating mode selecting light source module 400 further in the direction to tighten it onto light body 200, e.g., clockwise, by up to about 15-95° from the lockout detent position, brings the LED light source conductive area 440L and a ground conductive area 440G that is about 180° removed therefrom into electrical contact with the two contact springs 242, whereby the LED light source 442 in light source module 400 is connected to the control circuitry of light 100, 100', e.g., on control circuit board 440, so as to be energizable responsive to actuation of either or both of actuators 320.

Rotating mode selecting light source module 400 still further in the direction to remove it from light body 200, e.g., counter-clockwise, by up to about 180° from the fully seated position, again brings the lockout seat features 456 into registration to and engagement with electrical contacts 242 wherein mode selecting light source assembly 400 tends to be retained by the detent action thereof, and so resist being rotated other than by an intentional action by a user of light 100, 100'.

The mode selecting light source assemblies 400 of lights 100 and 100' are substantially similar except that the light source assembly 400 for light 100' need not (but may) include a contact for an infrared light source 444 if such light source is not provided. Mode selecting light source assembly 400 may have more or fewer contacts as may be necessary to enable changing modes between a greater or lesser number of different light sources and/or other modes of operation.

It is noted that each of the conductive areas 440IR, 440G, 440L of circuit board 440 provides a mode selecting electrical contact, e.g., an arcuate electrical contact, to which one or the other of electrical contacts 242 make contact at respective different predetermined angular positions relative to lockout feature 456 for selecting respective operating modes, e.g., locked out and OFF, illumination (white) light source selected, IR light source selected, and/or in some embodiments, laser light source selected. Operation of whichever of the provided light sources is selected remains under control by a user actuating one or the other or both of actuators 320 to actuate the respective electrical switch 362 or switches 362 associated therewith.

While the illustrated example mode selecting light source assembly 400 is not described as having function regarding laser light source 500, additional contacts thereon could be provided for selecting and de-selecting laser light source 500 if present. Further, in the lockout position where contact springs 242 are engaging the lockout seats 456, the lack of electrical connection therethrough may be used to signal the control circuitry to also lockout laser light source 500 from being energized.

Typically, battery 250 is inserted into light body 200, e.g., into main housing 210, with its positive terminal inward and with battery contact spring 450 making electrical contact with the negative terminal of battery 250. The two contact pads 440G, labeled "GROUND," are typically electrically connected to the contact pad that battery contact spring 450 touches. The contact pad 440L labeled "LED+" is typically electrically connected to the anode (positive) side of the white LED 442 and the other contact pad 440IR labeled "IR+" is electrically connected to the anode of the IR LED 444 (which may be two IR LEDs 444 in series). A single IR LED 444 may be connected to a series resistor or to additional circuitry to regulate the current flowing therethrough. The respective cathodes (negative sides) of the white LED 442 and of the IR LED 444 typically connect to "GROUND", or in the case of a single IR LED, supporting circuitry for controlling the current therethrough.

When light 100, 100' is in an active mode (either the white LED 442 or the IR LED 444 or both are to be energized, the control circuit board 350 is connected to the GROUND connection 440G (e.g., battery negative 450) through one contact 242 and drives a current via the other contact strap 242 which will either be connected to the anode of the white LED 442 or to the anode of the IR LED 444 and/or its supporting circuitry. The control or driver circuit board 350 is preferably regulating and/or sensing the output current applied to the LED 442, 444 and senses the voltage across that LED, and using that sensed data, a processor or microcontroller on circuit board 350 determines whether white LED 442 is selected or IR LED 444 is selected, and then can adjust the controlled current applied thereto to a predetermined level.

When mode selecting face cap 400 is rotated to the LOCKOUT/OFF mode 456, neither of the spring contacts 242 makes electrical connection to a conductor of the face cap circuit board 440 and so the LED circuit is unpowered because the battery 250 is electrically disconnected.

In a typical embodiment, light body 200 including housings and other parts thereof, e.g., parts 210, 224, 232, 240, 312, 340, 410, 452 thereof, may be of a nylon, an engineered nylon, an ABS plastic, a reinforced plastic, or any other suitable plastic that is molded, printed or otherwise formed, and heat sink 430 may be of an aluminum, brass, thermally conductive plastic, or any other suitable, and preferably thermally conductive, material. Parts such as main housing 210, clamp member 224 and key 232 may be of aluminum, brass, steel, or another suitable metal and may have a suitable surface coating, e.g., an anodized or powder coating or other insulating coating, thereon as may be necessary or desired.

A light 100 may comprise: a light body 200, 200' having a cavity for receiving a source of electrical power; a light source 400, 440 supported by the light body 200, 200' for selectively producing light; a tail cap assembly 300 of the light body 200, 200' may include one or more actuators 320 on one or more external surfaces of the tail cap assembly 300 configured for actuating one or more electrical switch contacts internal to the light body 200, 200' for selectively coupling the light source 400, 440 to the source of electrical power for energizing the light source 400, 440 to produce light; the tail cap assembly 300 may further include a housing shell 312 having one or more openings therethrough for defining one or more cantilevered supports extending from a support part of the housing shell and imparting flexibility to the one or more cantilevered supports, wherein the one or more actuators 320 are at respective ends of the one or more cantilevered supports distal from the support part of the housing shell, the tail cap assembly 300 may further include a resilient material 330 in the one or more openings through the housing shell for sealing the housing shell while leaving the actuators 320 flexibly cantilevered. The housing shell 312 may have first and second opposing surfaces and a connecting surface therebetween, the connecting surface of the housing shell 312 having a central part from which the respective cantilevered supports extend substantially to the first and second opposing surfaces and wherein the one or more actuators 320 include first and second actuators 320 located at the distal ends of the cantilevered supports and extending along the opposing surfaces of the housing shell 312, whereby each the actuator is movable inwardly to the housing shell 312 when pressed generally perpendicularly to an opposing surface and when pressed generally perpendicularly to the connecting surface. The one or more electrical switches 362 may include first and second electrical switches disposed in the light body 200, 200' adjacent the first and second actuators 320, whereby the first and/or second electrical switches are respectively actuated when the first and/or second actuators 320 are pressed as set forth in claim 2. The light 100 may further comprise a flexible circuit board 360 having a central contact pad and a pair of flexible arms extending therefrom, wherein: the first and second electrical switches 362 are disposed at respective ends of the flexible arms distal the central contact pad; or the first and second electrical switches 362 each include a snap dome switch contact disposed at a respective end of the flexible arms distal the central contact pad. Each of the cantilevered supports may be L-shaped with a longer part thereof extending from the central part of the housing shell 312 and with a shorter part thereof extending along one of the side surfaces, wherein the actuator extends from the distal end of the shorter part of the L-shaped cantilevered support along the one of the side surfaces in a direction toward the connecting surface. The one or more electrical switch contacts may include a snap dome switch contact. The housing shell 312 and the resilient material 330 may be molecularly bonded or may be chemically bonded to each other, thereby to from a permanent and rugged seal. The light 100 wherein: the resilient material 330 is over molded onto the housing shell 312; or the resilient material 330 is over molded onto the housing shell 312 without requiring a primer. The light source 400, 440 may comprise: a light source assembly 400 supported by the light body 200, 200' for selectively producing light, the light source assembly 400 may include: the light source 440 for producing light when energized; an optically reflective element 420 disposed adjacent the light source 440 for defining a light beam emitted by the light 100; a threaded member 430 supporting the light source 440 and the optically reflective element 420 and having a threaded cylindrical part defining an end of the light source assembly 400, wherein threads of the threaded member 430 are configured to be threaded into the threaded opening of the light body 200, 200; the end of the light source assembly 400 may have one or more ridges and/or recesses near the periphery of the threads thereof for engaging one or more of the one or more electrical contacts when the light source assembly 400 is at a first predetermined rotational position relative to the threaded opening of the light body 200, 200', the end of the light source assembly 400 having one or more mode selecting electrical contacts near the periphery thereof for respectively making electrical contact with the one or more electrical contacts of the light body 200, 200' when the light source assembly 400 is at one or more respective different predetermined rotational positions relative to the threaded opening of the light body 200, 200'. The light 100 may further comprise: a laser light source 510 may include a laser housing and a laser source therein configured to emit laser light from a forward end thereof along a longitudinal axis of the laser housing, the laser housing having a forward end substantially defining a portion of a hemisphere about the longitudinal axis, the laser housing defining a first side thereof that is substantially parallel to the longitudinal axis and defining a substantially flat second side thereof that is substantially parallel to the longitudinal axis and substantially perpendicular to the first side thereof, the first and second sides of the laser housing being spaced away from the forward end of the laser light source 510; the light body 200, 200' having a receptacle having a forward end configured for receiving the forward end of the laser housing and having an opening therethrough for passing the laser light emitted by the laser source; a biasing spring in the light body 200, 200' configured to bias the laser light source 510 to move transversely to the longitudinal axis in a direction that is not perpendicular to either the first side or to the second side of the laser housing; a first laser aiming screw in a threaded hole in the light body 200, 200' disposed for bearing against the first side of the laser housing in opposition to the bias of the biasing spring, wherein rotating the first laser aiming screw in a first direction causes the laser housing to move in a first direction in opposition to the bias of the biasing spring and wherein rotating the first laser aiming screw in a direction opposite to the first direction causes the laser housing to move in an opposite direction under the bias of the biasing spring; a second laser aiming screw in a threaded hole in the light body 200, 200' that is at an acute angle relative to the threaded hole for the first laser aiming screw, the second laser aiming screw being disposed for bearing against the second side of the laser housing in opposition to the bias of the biasing spring, wherein each of the first and second laser aiming screws has a longitudinal axis that is substantially transverse to the longitudinal axis of the laser housing, wherein the longitudinal axis the second laser aiming screw is at the acute angle relative to the longitudinal axis of the first laser aiming screw, wherein rotating the second laser aiming screw in a first direction causes the laser housing to move in a first direction in opposition to the bias of the biasing spring and wherein rotating the second laser aiming screw in a direction opposite to the first direction causes the laser housing to move in an opposite direction under the bias of the biasing spring, whereby the first and second laser aiming screws act upon the first and second surfaces of the laser housing in substantially perpendicular directions.

A light may comprise: a light body 200, 200' having a cavity for receiving a source of electrical power and having a threaded opening; one or more electrical contacts disposed proximate the threaded opening of the light body 200, 200; a light source assembly 400 supported by the light body 200, 200' for selectively producing light, the light source assembly 400 may include: a light source for producing light when energized; an optically reflective element disposed adjacent the light source for defining a light beam emitted by the light; a threaded member supporting the light source and the optically reflective element and having a threaded cylindrical part defining an end of the light source assembly 400, wherein threads of the threaded member are configured to be threaded into the threaded opening of the light body 200, 200; the end of the light source assembly 400 having one or more ridges and/or recesses near the periphery of the threads thereof for engaging one or more of the one or more electrical contacts when the light source assembly 400 is at a first predetermined rotational position relative to the threaded opening of the light body 200, 200', the end of the light source assembly 400 having one or more mode selecting electrical contacts near the periphery thereof for respectively making electrical contact with the one or more electrical contacts of the light body 200, 200' when the light source assembly 400 is at one or more respective different predetermined rotational positions relative to the threaded opening of the light body 200, 200; and wherein the one or more mode selecting electrical contacts of the light source assembly 400 are coupled to the source of electrical power via the one or more electrical contacts of the light body 200, 200' for energizing the light source. The light source assembly 400 may include: a face cap having threads that engage the threads of the threaded member for retaining the optically reflective element to the threaded member; or a lens adjacent the optically reflective element and a face cap having threads that engage the threads of the threaded member for retaining the lens and the optically reflective element to the threaded member. The light source assembly 400 may include: a circuit board adjacent the end of the threaded cylindrical part of the threaded member, wherein the one or more mode selecting electrical contacts are near a periphery of the circuit board; or a circuit board adjacent the end of the threaded cylindrical part of the threaded member, wherein the light source is mounted to a first surface of the circuit board and wherein the one or more mode selecting electrical contacts are on an opposing surface of the circuit board and near the periphery thereof. The light source assembly 400 may further include a retainer: the retainer retaining the circuit board adjacent the threaded member; or the retainer retaining the circuit board adjacent the threaded member and defining the one or more ridges and/or recess of the light source assembly 400; or the retainer retaining the circuit board adjacent the threaded member and defining the one or more ridges and/or recess and supporting the central electrical contact of the light source assembly 400. The end of the light source assembly 400 may include a central electrical contact supported by the circuit board and configured for connecting to the source of electrical power when the source of electrical power is disposed in the cavity of the light body 200, 200'. The end of the light source assembly 400 may include a central electrical spring contact configured to extend into the cavity of the light body 200, 200' for connecting to the source of electrical power when the source of electrical power is disposed therein and the light source assembly 400 is disposed in the threaded opening of the light body 200, 200'. The periphery of the circuit board is at least in part circular and wherein the mode selecting electrical contacts are arcuate electrical contacts. The light source assembly 400 may include a central electrical contact configured to extend into the cavity of the light body 200, 200' for connecting to the source of electrical power when the source of electrical power is disposed therein and the light source assembly 400 is disposed in the threaded opening of the light body 200, 200'. The light of claim 11 wherein: the threaded member is thermally conductive to provide a heat sink for the light source; or the light source may include a light emitting diode and the threaded member is thermally conductive to provide a heat sink for the light emitting diode. The light 100 may further comprise an electrical switch 362 supported by the light body 200, 200' for selectively causing the one or more electrical contacts of the light body 200, 200' to be coupled to the source of electrical power for energizing the light source. The light body 200, 200' may include: a tail cap assembly 300 may include one or more actuators 320 on one or more external surfaces of the tail cap assembly 300 configured for actuating one or more electrical switch contacts internal to the light body 200, 200' for selectively coupling the light source to the source of electrical power for energizing the light source to produce light; the tail cap assembly 300 may further include a housing shell 312 having one or more openings therethrough for defining one or more cantilevered supports extending from a support part of the housing shell 312 and imparting flexibility to the one or more cantilevered supports, wherein the one or more actuators 320 are at respective ends of the one or more cantilevered supports distal from the support part of the housing shell 312, the tail cap assembly 300 may further include a resilient material 330 in the one or more openings through the housing shell 312 for sealing the housing shell 312 while leaving the actuators 320 flexibly cantilevered. The electrical switch 362 may include one or more electrical switch contacts, and wherein each of the one or more electrical switch contacts is disposed adjacent to one of the one or more actuators 320 of the tail cap assembly 300. The light 100 may further comprise: a laser light source 510 may include a laser housing and a laser source therein configured to emit laser light from a forward end thereof along a longitudinal axis of the laser housing, the laser housing having a forward end substantially defining a portion of a hemisphere about the longitudinal axis, the laser housing defining a first side thereof that is substantially parallel to the longitudinal axis and defining a substantially flat second side thereof that is substantially parallel to the longitudinal axis and substantially perpendicular to the first side thereof, the first and second sides of the laser housing being spaced away from the forward end of the laser light source 510; the light body 200, 200' having a receptacle having a forward end configured for receiving the forward end of the laser housing and having an opening therethrough for passing the laser light emitted by the laser source; a biasing spring in the light body 200, 200' configured to bias the laser light source 510 to move transversely to the longitudinal axis in a direction that is not perpendicular to either the first side or to the second side of the laser housing; a first laser aiming screw in a threaded hole in the light body 200, 200' disposed for bearing against the first side of the laser housing in opposition to the bias of the biasing spring, wherein rotating the first laser aiming screw in a first direction causes the laser housing to move in a first direction in opposition to the bias of the biasing spring and wherein rotating the first laser aiming screw in a direction opposite to the first direction causes the laser housing to move in an opposite direction under the bias of the biasing spring; a second laser aiming screw in a threaded hole in the light body 200, 200' that is at an acute angle relative to the threaded hole for the first laser aiming screw, the second laser aiming screw being disposed for bearing against the second side of the laser housing in opposition to the bias of the biasing spring, wherein each of the first and second laser aiming screws has a longitudinal axis that is substantially transverse to the longitudinal axis of the laser housing, wherein the longitudinal axis the second laser aiming screw is at the acute angle relative to the longitudinal axis of the first laser aiming screw, wherein rotating the second laser aiming screw in a first direction causes the laser housing to move in a first direction in opposition to the bias of the biasing spring and wherein rotating the second laser aiming screw in a direction opposite to the first direction causes the laser housing to move in an opposite direction under the bias of the biasing spring, whereby the first and second laser aiming screws act upon the first and second surfaces of the laser housing in substantially perpendicular directions.

A light 100 including a laser light source arrangement 510 may comprise: a laser light source 510 may include a laser housing and a laser source therein configured to emit laser light from a forward end thereof along a longitudinal axis of the laser housing, the laser housing having a forward end substantially defining a portion of a hemisphere about the longitudinal axis, the laser housing defining a first side thereof that is substantially parallel to the longitudinal axis and defining a substantially flat second side thereof that is substantially parallel to the longitudinal axis and substantially perpendicular to the first side thereof, the first and second sides of the laser housing being spaced away from the forward end of the laser light source 510; a light body 200, 200' having a receptacle for receiving the laser light source 510 therein, the receptacle having a forward end configured for receiving the forward end of the laser housing and having an opening therethrough for passing the laser light emitted by the laser source; a biasing spring 540 in the light body 200, 200' configured to bias the laser light source 510 to move transversely to the longitudinal axis in a direction that is not perpendicular to either the first side or to the second side of the laser housing; a first laser aiming screw 520 in a threaded hole in the light body 200, 200' disposed for bearing against the first side of the laser housing in opposition to the bias of the biasing spring 540, wherein rotating the first laser aiming screw 520 in a first direction causes the laser housing 510 to move in a first direction in opposition to the bias of the biasing spring and wherein rotating the first laser aiming screw in a direction opposite to the first direction causes the laser housing 510 to move in an opposite direction under the bias of the biasing spring; a second laser aiming screw 530 in a threaded hole in the light body 200, 200' that is at an acute angle relative to the threaded hole for the first laser aiming screw 520, the second laser aiming screw 530 being disposed for bearing against the second side of the laser housing in opposition to the bias of the biasing spring 540, wherein each of the first and second laser aiming screws 520, 530 has a longitudinal axis that is substantially transverse to the longitudinal axis of the laser housing, wherein the longitudinal axis the second laser aiming screw is at the acute angle relative to the longitudinal axis of the first laser aiming screw, wherein rotating the second laser aiming screw 530 in a first direction causes the laser housing to move in a first direction in opposition to the bias of the biasing spring 540 and wherein rotating the second laser aiming screw 530 in a direction opposite to the first direction causes the laser housing to move in an opposite direction under the bias of the biasing spring 540, whereby the first and second laser aiming screws 520, 530 act upon the first and second surfaces of the laser housing in substantially perpendicular directions. The second laser aiming screw 530 may have a conical surface that bears against the second surface of the laser housing; or the second laser aiming screw 530 may have a conical surface that bears against the second surface of the laser housing and the conical surface has an included angle selected for the conical surface to bear substantially tangentially against the second surface of the laser housing; whereby the first and second laser aiming screws 520, 530 act upon the first and second surfaces of the laser housing in the substantially perpendicular directions. The second laser aiming screw 530 may have a coarser thread pitch than does the first laser aiming screw 520; or the second laser aiming screw 530 may have a coarser thread pitch than does the first laser aiming screw 520 and the coarser thread pitch may be selected so that each rotation of the second laser aiming screw 530 provides an angular change in elevation that approximates an angular change in azimuth produced by one rotation of the first laser aiming screw 520. The light body 200, 200' may include: a tail cap assembly 300 may include one or more actuators 320 on one or more external surfaces of the tail cap assembly 300 configured for actuating one or more electrical switch contacts internal to the light body 200, 200' for selectively coupling the laser light source to the source of electrical power for energizing the laser light source to produce light; the tail cap assembly 300 may further include a housing shell 312 having one or more openings therethrough for defining one or more cantilevered supports extending from a support part of the housing shell 312 and imparting flexibility to the one or more cantilevered supports, wherein the one or more actuators 320 are at respective ends of the one or more cantilevered supports distal from the support part of the housing shell 312, the tail cap assembly 300 may further include a resilient material 330 in the one or more openings through the housing shell 312 for sealing the housing shell 312 while leaving the actuators 320 flexibly cantilevered. The electrical switch 362 may include one or more electrical switch contacts, and wherein each of the one or more electrical switch contacts is disposed adjacent to one of the one or more actuators 320 of the tail cap assembly 300. A light source 400, 440 therefor may comprise: a light source assembly 400, 440 supported by the light body 200 for selectively producing light, the light source assembly 400, 440 may include: a light source 440 for producing light when energized; an optically reflective element disposed adjacent the light source for defining a light beam emitted by the light; a threaded member 430 supporting the light source 440 and the optically reflective element 420 and having a threaded cylindrical part defining an end of the light source assembly 400, wherein threads of the threaded member 430 are configured to be threaded into the threaded opening of the light body; the end of the light source assembly 400 having one or more ridges and/or recesses near the periphery of the threads thereof for engaging one or more of the one or more electrical contacts when the light source assembly is at a first predetermined rotational position relative to the threaded opening of the light body, the end of the light source assembly having one or more mode selecting electrical contacts near the periphery thereof for respectively making electrical contact with the one or more electrical contacts of the light body when the light source assembly is at one or more respective different predetermined rotational positions relative to the threaded opening of the light body.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B." In addition, the term "at least one of" one or more elements is intended to include one of any one of the elements, more than one of any of the elements, and two or more of the elements up to and including all of the elements, and so, e.g., the phrase in the form "at least one of A, B and C" includes "A," "B," "C," "A and B," "A and C," "B and C," and "A and B and C."

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both.

Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a single use or rechargeable Li-Ion battery typically producing about 3.0-3.5 volts, it being noted that the voltages produced thereby will be higher when approaching full charge and will be lower in discharge, particularly when providing higher current and when reaching a low level of charge, e.g., becoming discharged.

The term DC converter is used herein to refer to any electronic circuit that receives at an input electrical power at one voltage and current level and provides at an output DC electrical power at a different voltage and/or current level. Examples may include a DC-DC converter, an AC-DC converter, a boost converter, a buck converter, a buck-boost converter, a single-ended primary-inductor converter (SEPIC), a series regulating element, a current level regulator, and the like. The input and output thereof may be DC coupled and/or AC coupled, e.g., as by a transformer and/or capacitor. A DC converter may or may not include circuitry for regulating a voltage and/or a current level, e.g., at an output thereof, and may have one or more outputs providing electrical power at different voltage and/or current levels and/or in different forms, e.g., AC or DC.

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

As used herein, the terms "connected" and "coupled" as well as variations thereof are not intended to be exact synonyms, but to encompass some similar things and some different things. The term "connected" may be used generally to refer to elements that have a direct electrical and/or physical contact to each other, whereas the term "coupled" may be used generally to refer to elements that have an indirect electrical and/or physical contact with each other, e.g., via one or more intermediate elements, so as to cooperate and/or interact with each other, and may include elements in direct contact as well.

While the present invention has been described in terms of the foregoing example embodiments, variations within the scope and spirit of the present invention as defined by the claims following will be apparent to those skilled in the art. For example, light 100 may be configured with or without a laser light source 500, and/or with or without an azimuth and elevation adjustment as described. Further, a light 100, 100' may be configured with or without a light source assembly 400 that is configured to provide a mode selecting feature as described, and/or an IR light source.

Whereas in the description of example embodiments a single LED is described, e.g., for the illumination (white) LED 442 and for the IR LED 444, either or both LEDs may include plural LEDs that may be connected in series and/or in parallel, and may be arranged in an array in an appropriate optical position, as may be desired.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made. The lockout position of mode selecting light source assembly 400 of light 100, 100' is an example where such alternatives may be used.

Each of the U.S. Provisional Applications, U.S. Patent Applications, and/or U.S. Patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A light including a laser light source arrangement comprising:

a laser light source including a laser housing and a laser source therein configured to emit laser light from a forward end thereof along a longitudinal axis of the laser housing, said laser housing having a forward end substantially defining a portion of a hemisphere about the longitudinal axis, said laser housing defining a first side thereof that is substantially parallel to the longitudinal axis and defining a substantially flat second side thereof that is substantially parallel to the longitudinal axis and substantially perpendicular to the first side thereof, the first and second sides of the laser housing being spaced away from the forward end of said laser light source;

a light body having a receptacle for receiving said laser light source therein, the receptacle having a forward end configured for receiving the forward end of said laser housing and having an opening therethrough for passing the laser light emitted by the laser light source;

a biasing spring in said light body configured to bias said laser light source to move transversely to the longitudinal axis in a direction that is not perpendicular to either the first side or to the second side of said laser housing;

a first laser aiming screw in a threaded hole in said light body disposed for bearing against the first side of said laser housing in opposition to the bias of said biasing spring, wherein rotating said first laser aiming screw in a first direction causes the laser housing to move in a first direction in opposition to the bias of the biasing spring and wherein rotating said first laser aiming screw in a direction opposite to the first direction causes the laser housing to move in an opposite direction under the bias of the biasing spring;

a second laser aiming screw in a threaded hole in said light body that is at an acute angle relative to the threaded hole for said first laser aiming screw, said second laser aiming screw being disposed for bearing against the second side of said laser housing in opposition to the bias of said biasing spring, wherein each of said first and second laser aiming screws has a longitudinal axis that is substantially transverse to the longitudinal axis of said laser housing, wherein the longitudinal axis the second laser aiming screw is at the acute angle relative to the longitudinal axis of said first laser aiming screw, wherein rotating said second laser aiming screw in a first direction causes the laser housing to move in a first direction in opposition to the bias of the biasing spring and wherein rotating said second laser aiming screw in a direction opposite to the first direction causes the laser housing to move in an opposite direction under the bias of the biasing spring, whereby said first and second laser aiming screws act upon the first and second sides of said laser housing in substantially perpendicular directions.

2. The light including the laser light source arrangement of claim 1 wherein:

said second laser aiming screw has a conical surface that bears against the second side of said laser housing; or said second laser aiming screw has a conical surface that bears against the second side of said laser housing and the conical surface has an included angle selected for the conical surface to bear substantially tangentially against the second side of said laser housing;

whereby said first and second laser aiming screws act upon the first and second sides of said laser housing in the substantially perpendicular directions.

3. The light including the laser light source arrangement of claim 1 wherein:

said second laser aiming screw has a coarser thread pitch than does said first laser aiming screw; or said second laser aiming screw has a coarser thread pitch than does said first laser aiming screw and the coarser thread pitch is selected so that each rotation of said second laser aiming screw provides an angular change in elevation that approximates an angular change in azimuth produced by one rotation of said first laser aiming screw; or said second laser aiming screw bears against the second side of said laser housing at a different longitudinal position thereon than does said first laser aiming screw; or said second laser aiming screw bears against the second side of said laser housing at a different longitudinal position thereon than does said first laser aiming screw so that each rotation of said second laser aiming screw provides an angular change in elevation that approximates an angular change in azimuth produced by one rotation of said first laser aiming screw.

4. The light including the laser light source arrangement of claim 1 wherein said biasing spring is at an acute angle relative to the longitudinal axis of said laser light source and biases said laser light source in a direction toward the forward end thereof and toward both of said first and second laser aiming screws.

5. The light including the laser light source arrangement of claim 1 wherein the forward end of said laser housing is convex and the receptacle of said light body is concave.

6. The light including the laser light source arrangement of claim 1 wherein said first and second laser aiming screws are on a same side of said light body.

7. The light including the laser light source arrangement of claim 1 wherein said light body includes:

a housing shell having one or more openings therethrough for defining one or more cantilevered supports extending from a support part of said housing shell and imparting flexibility to the one or more cantilevered supports, and a resilient material in the one or more openings through the housing shell for sealing the housing shell while leaving the one or more cantilevered supports flexibly cantilevered.

8. The light including the laser light source arrangement of claim 7 wherein the one or more cantilevered supports are configured for actuating one or more electrical switch contacts internal to said light body for selectively coupling said laser light source to the source of electrical power for energizing said laser light source to produce light.

9. The light including the laser light source arrangement of claim 8 wherein each of the one or more electrical switch contacts is disposed adjacent to a respective one of the one or more cantilevered supports.

10. The light including the laser light source arrangement of claim 1 further comprising a light source assembly including:

a light source supported by said light source assembly for selectively producing light when energized;

an optically reflective element disposed adjacent said light source for defining a light beam emitted by said light;

said light source assembly having a threaded cylindrical part at an end thereof defining threads configured to be threaded into a threaded opening of said light body;

the end of said light source assembly having one or more ridges and/or recesses near the periphery of the threads thereof for engaging one or more electrical contacts of the threaded opening of said light body when said light source assembly is threaded into the threaded opening of said light body and at a first predetermined rotational position relative to said light body, the end of said light source assembly having one or more mode selecting electrical contacts near the periphery thereof for respectively making electrical contact with the one or more electrical contacts of said light body when said light source assembly is at one or more respective different predetermined rotational positions relative to the threaded opening of said light body.

11. A light including a laser light source arrangement comprising:

a laser light source including a laser housing and a laser source therein configured to emit laser light along a longitudinal axis of the laser housing, said laser housing having a curved surface about the longitudinal axis, said laser housing defining a first side thereof that is substantially parallel to the longitudinal axis and defining a second side thereof that is substantially parallel to the longitudinal axis and substantially perpendicular to the first side thereof, the first and second sides of the laser housing having portions that are spaced away from the curved surface thereof;

a light body having a receptacle for receiving said laser light source therein, the receptacle having a complementary curved surface for receiving the curved surface of said laser housing and having an opening for passing the laser light emitted by the laser light source;

first and second laser aiming screws in said light body each having a longitudinal axis that is substantially transverse to the longitudinal axis of said laser housing, wherein the longitudinal axis of the second laser aiming screw is at an acute angle relative to the longitudinal axis of said first laser aiming screw, wherein said first laser aiming screw is disposed in said light body for bearing against the first side of said laser housing in opposition to the bias of a biasing spring, wherein rotating said first laser aiming screw in a first direction causes the laser housing to move in a first longitudinal direction in opposition to the bias of the biasing spring and wherein rotating said first laser aiming screw in a direction opposite to the first direction causes the laser housing to move in an opposite longitudinal direction under the bias of the biasing spring;

wherein said second laser aiming screw is disposed in said light body for bearing against the second side of said laser housing in opposition to the bias of the biasing spring, wherein rotating said second laser aiming screw in a first direction causes the laser housing to move in a first longitudinal direction in opposition to the bias of the biasing spring and wherein rotating said second laser aiming screw in a direction opposite to the first direction causes the laser housing to move in an opposite longitudinal direction under the bias of the biasing spring, whereby said first and second laser aiming screws act upon the substantially flat first and second sides of said laser housing in substantially perpendicular directions.

12. The light including the laser light source arrangement of claim 11 wherein:

said second laser aiming screw has a conical surface that bears against the second side of said laser housing; or said second laser aiming screw has a conical surface that bears against the second side of said laser housing and the conical surface has an included angle selected for the conical surface to bear substantially tangentially against the second surface of said laser housing;

whereby said first and second laser aiming screws act upon the first and second sides of said laser housing in the substantially perpendicular directions.

13. The light including the laser light source arrangement of claim 11 wherein:

said second laser aiming screw has a coarser thread pitch than does said first laser aiming screw; or said second laser aiming screw has a coarser thread pitch than does said first laser aiming screw and the coarser thread pitch is selected so that each rotation of said second laser aiming screw provides an angular change in elevation that approximates an angular change in azimuth produced by one rotation of said first laser aiming screw; or said second laser aiming screw bears against the second side of said laser housing at a different longitudinal position thereon than does said first laser aiming screw; or said second laser aiming screw bears against the second side of said laser housing at a different longitudinal position thereon than does said first laser aiming screw so that each rotation of said second laser aiming screw provides an angular change in elevation that approximates an angular change in azimuth produced by one rotation of said first laser aiming screw.

14. The light including the laser light source arrangement of claim 11 wherein:

the biasing spring in said light body is configured to bias said laser light source to move transversely to the longitudinal axis in a direction that is not perpendicular to either the first side or to the second side of said laser housing; or the biasing spring in said light body is at an acute angle relative to the longitudinal axis of said laser light source and biases said laser light source in a direction toward the curved surface thereof and toward both of said first and second laser aiming screws; or the biasing spring in said light body is at an acute angle relative to the longitudinal axis of said laser light source to bias said laser light source to move transversely to the longitudinal axis in a direction toward the curved surface thereof and toward both of said first and second laser aiming screws thereof, and that is not perpendicular to either the first side or to the second side of said laser housing.

15. The light including the laser light source arrangement of claim 11 wherein the curved surface of said laser housing is convex and the curved receptacle of said light body is concave.

16. The light including the laser light source arrangement of claim 11 wherein said first and second laser aiming screws are on a same side of said light body.

17. The light including the laser light source arrangement of claim 11 wherein:

a portion of the first side of said laser housing is substantially flat; or a portion of the second side of said laser housing is substantially flat; or a portion of the first side of said laser housing is substantially flat and a portion of the second side of said laser housing is substantially flat.

18. The light including the laser light source arrangement of claim 11 wherein said light body includes:

a housing shell having one or more openings therethrough for defining one or more cantilevered supports extending from a support part of said housing shell and imparting flexibility to the one or more cantilevered supports, and a resilient material in the one or more openings through the housing shell for sealing the housing shell while leaving the one or more cantilevered supports flexibly cantilevered.

19. The light including the laser light source arrangement of claim 18 wherein the one or more cantilevered supports are configured for actuating one or more electrical switch contacts internal to said light body for selectively coupling said laser light source to the source of electrical power for energizing said laser light source to produce light.

20. The light including the laser light source arrangement of claim 19 wherein each of the one or more electrical switch contacts is disposed adjacent to a respective one of the one or more cantilevered supports.

21. The light including the laser light source arrangement of claim 11 further comprising a light source assembly including:

a light source supported by said light source assembly for selectively producing light when energized;

an optically reflective element disposed adjacent said light source for defining a light beam emitted by said light;

said light source assembly having a threaded cylindrical part at an end thereof defining threads configured to be threaded into a threaded opening of said light body;

the end of said light source assembly having one or more ridges and/or recesses near the periphery of the threads thereof for engaging one or more electrical contacts of the threaded opening of said light body when said light source assembly is threaded into the threaded opening of said light body and at a first predetermined rotational position relative to said light body, the end of said light source assembly having one or more mode selecting electrical contacts near the periphery thereof for respectively making electrical contact with the one or more electrical contacts of said light body when said light source assembly is at one or more respective different predetermined rotational positions relative to the threaded opening of said light body.

22. A light including a laser light source arrangement comprising:

a laser light source including a laser housing and a laser source therein configured to emit laser light along a longitudinal axis of the laser housing, said laser housing having a curved surface substantially defining a portion of a hemisphere about the longitudinal axis, said laser housing defining a first side thereof that is substantially parallel to the longitudinal axis and defining a second side thereof that is substantially parallel to the longitudinal axis and substantially perpendicular to the first side thereof, the first and second sides of the laser housing having portions that are spaced away longitudinally from the curved surface thereof;

a light body having a receptacle for receiving said laser light source therein, the receptacle having a complementary curved surface for receiving the curved surface of said laser housing and having an opening therethrough for passing the laser light emitted by the laser light source in a forward direction, said light body having a top, a bottom, sides and a forward end and supporting an illumination light source directing light in the forward direction;

an azimuth laser aiming screw and an elevation laser aiming screw each having a longitudinal axis that is substantially transverse to the longitudinal axis of said laser housing, wherein the longitudinal axis of the elevation laser aiming screw is at an acute angle relative to the longitudinal axis of said azimuth laser aiming screw, wherein said azimuth laser aiming screw is disposed in a threaded hole in a side of said light body for bearing against the first side of said laser housing in opposition to the bias of a biasing spring, wherein rotating said azimuth laser aiming screw in a first direction causes the laser housing to move in a first side to side direction relative to said light body in opposition to the bias of the biasing spring and wherein rotating said first laser aiming screw in a direction opposite to the first direction causes the laser housing to move in an opposite side to side direction under the bias of the biasing spring;

wherein said elevation laser aiming screw is disposed in a threaded hole in a side of said light body that is at an acute angle relative to the threaded hole for said azimuth laser aiming screw and has a conical end for bearing against the second side of said laser housing at an acute angle in opposition to the bias of the biasing spring, wherein rotating said elevation laser aiming screw in a first direction causes the laser housing to move in a first top to bottom direction in opposition to the bias of the biasing spring and wherein rotating said elevation laser aiming screw in a direction opposite to the first direction causes the laser housing to move in an opposite top to bottom direction under the bias of the biasing spring, whereby said azimuth and elevation laser aiming screws act upon the first and second sides of said laser housing in substantially perpendicular directions for aiming the laser light emitted therefrom in azimuth and elevation;

one or more electrical switch contacts for selectively coupling said laser light source and or said illumination light source to a source of electrical power for energizing said laser light source and/or said illumination light source to produce light; and a mounting clamp on the top of said light body.

23. The light including the laser light source arrangement of claim 22 wherein:

the conical end of said elevation laser aiming screw bears against a substantially flat portion of the second side of said laser housing; or the conical end of said elevation laser aiming screw bears against a substantially flat portion of the second side of said laser housing and the conical end has an included angle selected for the conical end to bear substantially tangentially against the substantially flat portion of the second side of said laser housing;

whereby said azimuth and elevation laser aiming screws act upon the first and second sides of said laser housing in the substantially perpendicular directions.

24. The light including the laser light source arrangement of claim 22 wherein:

said elevation laser aiming screw has a coarser thread pitch than does said azimuth laser aiming screw; or said elevation laser aiming screw has a coarser thread pitch than does said azimuth laser aiming screw and the coarser thread pitch is selected so that each rotation of said elevation laser aiming screw provides an angular change in elevation that approximates an angular change in azimuth produced by one rotation of said azimuth laser aiming screw; or said elevation laser aiming screw bears against the second side of said laser housing at a different longitudinal position thereon than does said azimuth laser aiming screw; or said elevation laser aiming screw bears against the second side of said laser housing at a different longitudinal position thereon than does said azimuth laser aiming screw so that each rotation of said elevation laser aiming screw provides an angular change in elevation that approximates an angular change in azimuth produced by one rotation of said azimuth laser aiming screw.

25. The light including the laser light source arrangement of claim 22 wherein:

the biasing spring in said light body is configured to bias said laser light source to move transversely to the longitudinal axis in a direction that is not perpendicular to either the first side or to the second side of said laser housing; or the biasing spring in said light body is at an acute angle relative to the longitudinal axis of said laser light source and biases said laser light source in a direction toward the curved surface thereof and toward both of said first and second laser aiming screws; or the biasing spring in said light body is at an acute angle relative to the longitudinal axis of said laser light source to bias said laser light source to move transversely to the longitudinal axis in a direction toward the curved surface thereof and toward both of said first and second laser aiming screws thereof, and that is not perpendicular to either the first side or to the second side of said laser housing.

26. The light including the laser light source arrangement of claim 22 wherein the forward end of said laser housing is convex and the receptacle of said light body is concave.

27. The light including the laser light source arrangement of claim 22 wherein said azimuth and elevation laser aiming screws are on the same side of said light body.

28. The light including the laser light source arrangement of claim 22 wherein:

a portion of the first side of said laser housing is substantially flat; or a portion of the second side of said laser housing is substantially flat; or a portion of the first side of said laser housing is substantially flat and a portion of the second side of said laser housing is substantially flat.

29. The light including the laser light source arrangement of claim 22 wherein said light body includes:

a housing shell having one or more openings therethrough for defining one or more cantilevered supports extending from a support part of said housing shell and imparting flexibility to the one or more cantilevered supports; and a resilient material in the one or more openings through the housing shell for sealing the housing shell while leaving the one or more cantilevered supports flexibly cantilevered;

wherein the one or more electrical switch contacts are internal to said light body adjacent the one or more cantilevered supports for being actuated by the one or more cantilevered supports.

30. The light including the laser light source arrangement of claim 22 further comprising a light source assembly including the illumination light source and:

an optically reflective element disposed adjacent said illumination light source for defining a light beam emitted thereby;

said light source assembly having a threaded cylindrical part at an end thereof defining threads configured to be threaded into a threaded opening of said light body;

the end of said light source assembly having one or more ridges and/or recesses near the periphery of the threads thereof for engaging one or more electrical contacts of the threaded opening of said light body when said light source assembly is threaded into the threaded opening of said light body and at a first predetermined rotational position relative to said light body, the end of said light source assembly having one or more mode selecting electrical contacts near the periphery thereof for respectively making electrical contact with the one or more electrical contacts of said light body when said light source assembly is at one or more respective different predetermined rotational positions relative to the threaded opening of said light body.

* * * * *